US005742123A

United States Patent [19]

Nagayama

[11] Patent Number: 5,742,123

[45] Date of Patent: Apr. 21, 1998

[54] SEALING STRUCTURE FOR LIGHT-EMITTING BULB ASSEMBLY AND METHOD OF MANUFACTURING SAME

[75] Inventor: Hiroyuki Nagayama, Fukuoka, Japan

[73] Assignee: Toto Ltd., Fukuoka, Japan

[21] Appl. No.: 869,877

[22] Filed: Jun. 5, 1997

Related U.S. Application Data

[63] Continuation of Ser. No. 370,310, filed as PCT/JP93/00959, Jul. 9, 1993 published as WO94/01884, Jan. 20, 1994, abandoned.

[30] Foreign Application Priority Data

| | | | |
|---|---|---|---|
| Jul. 9, 1992 | [JP] | Japan | 4-206092 |
| Nov. 9, 1992 | [JP] | Japan | 4-323676 |
| Jan. 25, 1993 | [JP] | Japan | 5-028682 |

[51] Int. Cl.[6] ..... H01J 5/04

[52] U.S. Cl. ..... 313/623; 313/624; 313/625; 313/626

[58] Field of Search ..... 313/623, 624, 313/625, 626

[56] References Cited

U.S. PATENT DOCUMENTS

| | | | |
|---|---|---|---|
| 3,742,283 | 6/1973 | Loughridge | 313/623 |
| 4,004,173 | 1/1977 | Rigden | 313/624 |
| 4,691,142 | 9/1987 | Dohmen | 313/623 |

FOREIGN PATENT DOCUMENTS

| | | |
|---|---|---|
| 0528428A1 | 8/1992 | European Pat. Off. . |
| 93914987 | 3/1997 | European Pat. Off. . |
| 2032277 | 6/1970 | Germany . |
| 45-30431 | 10/1970 | Japan . |
| 62-213061 | 9/1987 | Japan . |
| 63-308861 | 12/1988 | Japan . |
| 1-143132 | 6/1989 | Japan . |
| 1-302652 | 12/1989 | Japan . |
| 2-15557 | 1/1990 | Japan . |

*Primary Examiner*—Sandra L. O'Shea
*Assistant Examiner*—Vip Patel
*Attorney, Agent, or Firm*—Weiner, Carrier, Burt & Esser, P.C.; Joseph P. Carrier; Irving M. Weiner

[57] ABSTRACT

A sealing structure for a light-emitting bulb assembly includes a closure, having a core which serves as an electrode for sealing an open end of a bulb. The closure includes a bulb-side region disposed adjacent to the open end of the bulb and made of a compositional ingredient having a coefficient of thermal expansion which is substantially the same as that of the bulb, a core-side region disposed adjacent to the core and made of a compositional ingredient having a coefficient of thermal expansion which is substantially the same as that of the core, and an intermediate region disposed between the bulb-side region and the core-side region and made of a compositional ingredient having compositional proportions adjusted such that a coefficient of thermal expansion thereof varies gradually from the coefficient of thermal expansion of the bulb-side region toward the coefficient of thermal expansion of the core-side region. The bulb-side region and the core-side region are separated from each other by the intermediate region and comprise a bulb-side region layer and a core-side region layer, respectively, which are independent of each other. The intermediate region comprises at least one layer whose coefficient of thermal expansion varies gradually from the bulb-side region toward the core-side region. The layers of the closure are progressively thicker from the bulb-side region layer toward the core-side region layer.

37 Claims, 21 Drawing Sheets

FIG.18(a)
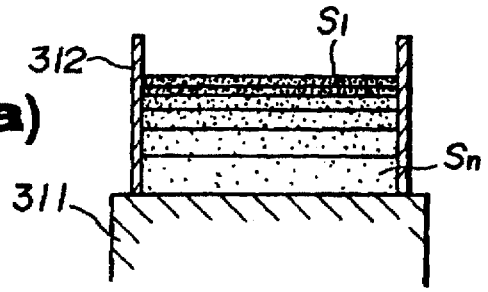
FIG.18(b)
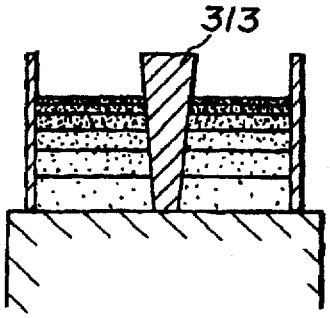
FIG.18 (c)
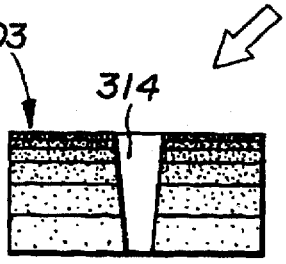
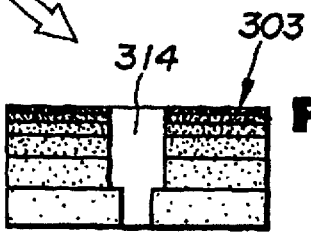
FIG.18 (d)
FIG.18 (e)
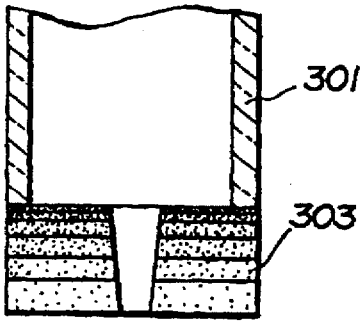

412
411
412

413
411

411
413
413
C44
S42

411
413
414

413
415
414

11

SEALING STRUCTURE FOR LIGHT-EMITTING BULB ASSEMBLY AND METHOD OF MANUFACTURING SAME

This is a file wrapper continuation of prior application Ser. No. 08/370,310 filed 9 Jan. 1995 (now abandoned) which is a continuation of PCT application PCT/JP93/00959 filed 9 Jul. 1993 (now abandoned).

TECHNICAL FIELD

The present invention relates to a sealing structure for a light-emitting bulb assembly for use in a metal-vapor discharge lamp such as a mercury-vapor lamp, a metal halide lamp, or a sodium-vapor lamp, or a high-intensity discharge lamp, and a method of manufacturing such a light-emitting bulb assembly.

BACKGROUND ART

Metal-vapor discharge lamps include a mercury-vapor lamp, a metal halide lamp, and a sodium-vapor lamp. The mercury-vapor lamp emits light excited from the mercury in a positive column produced in a hot-cathode arc discharge. In the metal halide lamp, a metal halide is evaporated into a metal and a halogen by the heat of a mercury hot-cathode arc discharge to emit light in a color inherent in the metal. The sodium-vapor lamp emits light in yellowish orange at a D line (589.0 nm, 589.9 nm) produced by a hot-cathode arc of a sodium vapor. Heretofore, such metal-vapor discharge lamps have been used as illuminating lamps for gymnasiums and factories, light sources for overhead projectors and color liquid crystal projectors, fog lamps for automobiles, and so on.

The bulbs of metal-vapor discharge lamps were initially made of quartz glass. However, since the quartz glass has poor fade resistance and a large thermal capacity, the metal-vapor discharge lamps cannot be turned on quickly and the individual bulbs have large dimensional variations. Therefore, it has recently been proposed to make bulbs of light-transmissive ceramic.

Generally, a light-emitting bulb assembly for a discharge lamp comprises a bulb made of light-transmissive ceramic in the form of fired alumina or the like, and a closure by which an electrode supported by an electrode support is sealed and fixed in the bulb. To join the closure hermetically to an open end of the bulb, a glass solder is filled in a gap between end and inner surfaces of the open end of the bulb and a confronting surface of the closure, heating the glass solder to melt same, and then cooling and solidifying the melted glass solder.

It is the general practice for the closure to have the same coefficient of thermal expansion as and to be as chemically stable against metal vapor and halogen vapor as the bulb or the electrode support.

When the closure is joined to the bulb by the glass solder, a starting rare gas and a discharging metal component depending on the discharge lamp which incorporates the bulb assembly, e.g., mercury if the discharge lamp is a high-pressure mercury vapor lamp, or a metal halide if the discharge lamp is a metal halide lamp, are sealed in the bulb.

The bulb assembly is turned on, its temperature momentarily increases from the atmospheric temperature to 900° C. at which the bulb assembly remains energized stably. High thermal stresses are developed in the bulb assembly due to such a large thermal change and a change in the internal pressure.

When thermal stresses are produced, thermal strains are developed in a portion having a different coefficient of thermal expansion, specifically the closure that is interposed between the bulb and the electrode support, tending to cause the closure to be deteriorated or broken. More specifically, cracks are produced in the closure itself and the glass solder which has lower heat resistance than the light-transmissive ceramic and the closure because of its composition, allowing the discharging metal component to leak out of the bulb. As a result, the bulb assembly is not reliable in producing stable light emission, and the service life of the lamp is limited.

In a high-temperature, high-pressure environment in which the temperature and the internal pressure of the bulb assembly are increased, a metal halide (e.g., $TlI_3$, NaI, or the like) sealed as a discharging metal component is liberated as ions which erode the bulb assembly.

The liberated ions erode the glass solder more quickly because the glass solder has lower erosion resistance than the light-transmissive ceramic and the closure because of its composition. The glass solder is liable to crack also due to the low erosion resistance against the erosion caused by the liberated ions.

Highly pure light-transmissive alumina which is used in the bulb has poor wettability with respect to the glass solder. Therefore, the bonding strength at the boundary between the glass and the bulb is low, tending to produce cracks and a leakage of the sealed gas.

Various arrangements have heretofore been proposed in order to solve the above problems.

Japanese laid-open patent publication No. 1-143132 discloses a technique for brazing an insert having a coefficient of thermal expansion similar to that of alumina to a sealed region of an outer circumferential element of alumina which corresponds to a bulb. According to Japanese laid-open patent publication No. 63-308861, a closure is composed of a central body and an annular body disposed around the central body, and a bulb is joined in solid phase to the closure (the central body and the annular body). Japanese laid-open patent publication No. 63-308861 particularly proposes specific dimensions and compositions of the central body and the annular body which make up the closure. Specified dimensions are also proposed in Japanese laid-open patent publication No. 62-21306.

The disclosed proposals are effective in suppressing a leakage of the discharging metal component from the bulb assembly for thereby keeping reliable light emission and increasing the service life of the lamp.

However, recent years have seen a demand for brighter light emission to achieve higher added values of light-emitting bulb assemblies, and it has been practiced to increase the temperature of a light-emitting bulb assembly up to about 1200° C. in excess of the conventional temperature of 900° C. in order to attain brighter light emission.

Since the higher bulb temperature leads to corresponding thermal stresses in the bulb assembly, the conventional light-emitting bulb assembly fails to keep sufficiently reliable light emission and have a sufficiently long service life. Specified dimensions of the closure and other parts are not preferable as they pose limitations on the configurations of the light-emitting bulb assembly and also the configurations of the lamp which accommodates the light-emitting bulb assembly.

The present invention has been made in order to solve the above problems. It is an object of the present invention to provide a light-emitting bulb assembly which is highly reliable and has a long service life, and particularly a novel sealing structure for such a light-emitting bulb assembly and a simple method of manufacturing such a light-emitting bulb assembly.

Other objects, advantages and salient features of the invention will be apparent from the following description which, when taken in conjunction with the annexed drawings, discloses preferred embodiments of the invention.

SUMMARY OF THE INVENTION

Means and processes employed according to the present invention for achieving the above object are as follows:

A sealing structure for a light-emitting bulb assembly, includes a closure, having a core which serves as an electrode for sealing an open end of a bulb, the closure including a bulb-side region disposed adjacent to the open end of the bulb and made of a compositional ingredient having a coefficient of thermal expansion which is substantially the same as that of the bulb, a core-side region disposed adjacent to the core and made of a compositional ingredient having a coefficient of thermal expansion which is substantially the same as that of the core, and an intermediate region disposed between the bulb-side region and the core-side region and made of a compositional ingredient having compositional proportions adjusted such that a coefficient of thermal expansion thereof varies gradually from the coefficient of thermal expansion of the bulb-side region toward the coefficient of thermal expansion of the core-side region.

Preferably, layers of the closure are progressively thicker from the bulb-side region layer toward the core-side region layer.

The bulb should preferably be made of light-transmissive ceramic, particularly highly pure alumina, and the core should preferably be made primarily of tungsten.

The closure may be made of a gradient function material.

The above sealing structure may be manufactured by a method given below.

A method of manufacturing a light-emitting bulb assembly including a closure, having a core which serves as an electrode for sealing an open end of a light-transmissive bulb, comprises the steps of:

(a) preparing, from a fine powder of a light-transmissive bulb ingredient and a fine powder of a core ingredient, a bulb ingredient suspension in which the proportion of light-transmissive bulb ingredient is greater than the proportion of core ingredient, a core ingredient suspension in which the core proportion of ingredient is greater than the proportion of light-transmissive bulb ingredient, and at least one intermediate suspension in which the light-transmissive bulb ingredient and the core ingredient have compositional proportions lying between those of the bulb ingredient suspension and the core ingredient suspension;

(b) forming an unfired laminated body composed of an unfired bulb-side region layer to be disposed adjacent to the light-transmissive bulb and formed from the bulb ingredient suspension, an unfired core-side region layer to be disposed adjacent to the core and formed from the core ingredient suspension, and at least one unfired intermediate region layer disposed between the unfired bulb-side region layer and the unfired core-side region layer and formed from the at least one intermediate suspension; and (c) firing the unfired laminated body.

The step (b) may comprise the steps of:

(d) pouring the bulb ingredient suspension into a cavity defined in a mold assembly composed of a plurality of joined molds each made of a porous material, causing a solvent of the bulb ingredient suspension to penetrate into the mold assembly, and thereafter discharging an excessive amount of the bulb ingredient suspension from the mold assembly, thereby forming the bulb-side region layer on an inner surface of the cavity;

(e) thereafter, successively pouring the at least one intermediate suspension and the core ingredient suspension onto an inner surface of the bulb-side region layer, allowing solvents of the at least one intermediate suspension and the core ingredient suspension to penetrate into the mold assembly, and thereafter discharging excessive amounts of the at least one intermediate suspension and the core ingredient suspension from the mold assembly, thereby forming a molded laminated body; and (f) separating the molds from each other, thereby releasing the molded laminated body as the unfired laminated body.

Alternatively, the step (b) may comprise the steps of producing green sheets respectively from the core ingredient suspension, the at least one intermediate suspension, and the bulb ingredient suspension, and successively winding the green sheets around the core, thereby forming the unfired laminated body.

In the above sealing structure, the core comprises a conductive core made of tungsten or the like, and the closure hermetically joined in solid phase to the opening of the bulb comprises a fired laminated body composed of a core-side region layer, at least one intermediate region layer, and a bulb-side region layer which are successively arranged from the conductive core toward the bulb. The core-side region layer includes at least 50% by volume of an ingredient of the conductive core, and the bulb-side region layer includes at least 80% by volume of an ingredient of light-transmissive ceramic or ingredient. The intermediate region layer between the core-side region layer and the bulb-side region layer includes light-transmissive ceramic having a volume ratio which is progressively closer to the volume ratio of the light-transmissive ceramic of the bulb-side region in a direction toward the bulb-side region, and also includes the ingredient of the core having a volume ratio which is progressively closer to the volume ratio of the ingredient of the core in the core-side region layer in a direction toward the core-side region layer.

In each of the layers of the closure, a network structure of crystals is formed between common ingredients by firing, thereby integrally joining the ingredients. A firing process for reducing surface energy is applied to the joining of the core and the opening of the bulb to each other. Impurities such as of glass are often added in a small amount in an effort to accelerate the firing process.

More specifically, each of the layers traps the powder of the ingredient of the conductive core, and the ingredient of the light-transmissive ceramic forms a solid solution and is crystallized. Adjacent layers are integrally joined to each other in solid phase as the ingredient of the light-transmissive ceramic in the layers forms a solid solution and is crystallized at the mating surfaces of the layers. The conductive core and the core-side region layer are also integrally joined to each other in solid phase because the ingredient of the light-transmissive ceramic in the core-side region layer is crystallized in contact with the core, forming a glassy substance which fills in its grain boundaries, and also because the ingredient of the conductive core is contained in both the core and the core-side region layer. Furthermore, the bulb-side region layer and the bulb are also integrally joined to each other in solid phase because the ingredient of the light-transmissive ceramic in the bulb-side region layer is crystallized in contact with the bulb, forming a glassy substance which fills in its grain boundaries, and also because the ingredient of the light-transmissive ceramic is contained in both the bulb-side region layer and the bulb.

Therefore, the closure after it has been fired is firmly bonded to the conductive core, making it possible to seal a main electrode. Additionally, the closure after it has been fired makes it possible to hermetically seal the opening of the bulb through the formation of a glass phase in the grain boundaries of the ingredient of the light-transmissive ceramic in the bulb-side region layer and the bulb.

In addition, the distribution of coefficients of thermal expansion from the conductive core through the core-side region layer, the intermediate region layer, and the bulb-side region layer to the bulb is a gradient distribution ranging from the coefficient of thermal expansion of the conductive core to the coefficient of thermal expansion of the bulb.

In the method of manufacturing the sealing structure, when the closure to be hermetically joined in solid phase to the opening of the bulb which is made of light-transmissive ceramic is to be fired, an unfired core-side region layer, an unfired intermediate region layer, and an unfired bulb-side region layer are successively stacked on a core made of a conductive material, thereby forming an unfired laminated body.

The unfired core-side region layer, the unfired termediate region layer, and the unfired bulb-side region layer which are successively stacked are formed from a core ingredient suspension including a powder of a conductive material ingredient or a core ingredient and a powder of a light-transmissive ceramic ingredient or a bulb ingredient, with at least 50% by volume of the conductive material ingredient, a bulb ingredient suspension including both powders with at least 80% by volume of the light-transmissive ceramic ingredient, and a plurality of intermediate suspensions including both powders with the volume ratio of the light-transmissive ceramic ingredient being progressively increased to a value close to 100% and the volume ratio of the conductive material ingredient being progressively reduced from 100%.

To successively deposit the unfired core-side region layer, the unfired intermediate region layers, and the unfired bulb-side region layer on an outer surface of the core, they are deposited in a descending order of volume ratios of the conductive material ingredient, thereby forming the unfired laminated body. Thereafter, the unfired laminated body is disposed at the opening of the bulb so as to position the main electrode connected to the core in the bulb, and then fired.

After the laminated body has been fired, since the light-transmissive ceramic ingredient forms a solid solution and is crystallized, trapping the powder of the core ingredient, in each of the layers, the fired closure is of an integral structure achieved by the formation of a solid solution of and crystallization of the light-transmissive ceramic ingredient between adjacent ones of the layers. The fired closure is firmly bonded to the core, making it possible to seal the main electrode, through the formation of a glass phase in the grain boundaries of the light-transmissive ceramic ingredient in the core-side region layer while it is being held in contact with the core, and also through the coexistence of the conductive core ingredient. The fired closure also makes it possible to hermetically seal the opening of the bulb through the formation of a glass phase in the grain boundaries of the light-transmissive ceramic ingredient in the bulb-side region layer and the bulb.

Moreover, the distribution of coefficients of thermal expansion from the core through the core-side region layer, the intermediate region layers and the bulb-side region layer to the bulb is a gradient distribution ranging from the coefficient of thermal expansion of the core to the coefficient of thermal expansion of the bulb.

BRIEF DESCRIPTION OF THE DRAWINGS

FIGS. 18(*a*) through 18(*e*) are diagram showing a slip-casting process;

DETAILED DESCRIPTION OF BEST MODE FOR CARRYING OUT THE INVENTION

Preferred embodiments of light-emitting bulb assemblies according to the present invention will be described below with reference to the drawings.

Figure 1:
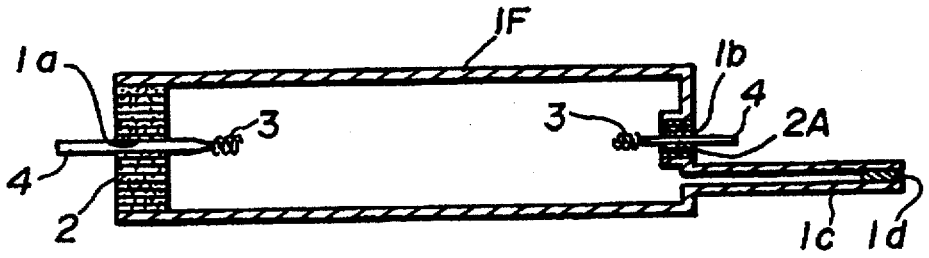
FIG. 1 is a cross-sectional view of a light-emitting bulb assembly according to a first embodiment of the present invention.

As shown in FIG. 1, a light-emitting bulb assembly according to a first embodiment of the present invention comprises a tubular bulb 1F, a closure 2 fixedly mounted in an electrode holding hole 1*a* defined in a larger-diameter open end of the bulb 1F, a closure 2A fixedly mounted in an electrode holding hole 1*b* defined in a smaller-diameter open end of the bulb 1F, and a pair of main electrodes 3 disposed in the bulb 1F. The main electrodes 3 are in the form of tungsten coils, respectively, which are supported by respective support shafts 4 of tungsten which extend through the closures 2, 2A. The closures 2, 2A differ from each other only with respect to their diameters, and are produced by a manufacturing process which will be described later on.

The end of the bulb 1F with the electrode holding hole 1*b* has a slender introduction tube 1*c*for entering a starting rare gas metal and various discharging material amalgams. The slender introduction tube 1*c* has an open end sealed by a sealant 1*d* of a cermet of alumina or a metal such as nickel or the like.

A process of manufacturing the light-emitting bulb assembly 1, including a process of manufacturing the bulb 1F and the closure 2, and the manner of supporting the main electrodes 3 with the support shafts 4 will successively be described below.

Synthesis of a fine powder of alumina which will be used as a material of the bulb and the closure will first be described below.

To synthesize a fine powder of alumina, an aluminum salt which will become alumina having a purity of 99.98 mol % or more when thermally decomposed is used as a starting material.

An aluminum salt for synthesizing such highly pure alumina may be ammonium alum or aluminum ammonium carbonite hydroxysite ($NH_4AlCO_3(OH)_2$).

The aluminum salt is then weighed, dissolved1Ftogether with a dispersing agent in distilled water, thus producing a suspended aqueous solution, and then dried by a spray drying process. The dried aluminum salt is thereafter thermally decomposed, thereby producing a fine powder of alumina only. The dried aluminum salt is thermally decomposed at 900~2000° C. e.g., 1050° C., in the atmosphere for 2 hours. The fine powder of alumina produced by the spray drying process and the thermal decomposition has an average particle diameter ranging from 0.2 to 0.3 μm and a purity of 99.99 mol % or higher. The fine powder of alumina is thus prepared. The synthesized fine powder of alumina is obtained as a secondary aggregate of fine powder of alumina having the above particle diameter, the secondary aggregate being of a size greater than the above particle diameter.

As another material of the closure besides alumina, a fine powder of tungsten is prepared which has a purity of 99 mol % or higher and an average particle diameter of about 0.5 μm.

The bulb 1F and the closure 2 are fabricated of the above materials, respectively.

The bulb 1F is manufactured as follows:

To the synthesized fine powder of alumina (secondary aggregate), there is added an organic binder which is composed primarily of an acrylic thermoplastic resin. The fine powder of alumina and the added organic binder are mixed with each other in a wet manner using an organic solvent such as of alcohol, benzene, or the like by a plastic (nylon) ball mill for about 24 hours, so that the fine powder of alumina and the organic binder are sufficiently wetted. The mixture is then distilled and dried, thereby removing the solvent, and kneaded into a compound having a desired viscosity ranging from 50,000 to 150,000 cps.

The organic binder is a mixture of an acrylic thermoplastic resin, paraffin wax, and atactic polypropylene. The total amount of the organic binder with respect to 100 g of the fine powder of alumina is 25 g.

The ingredients of the organic binder are of the following proportions, and adds up to the total amount (25 g) of the organic binder:

| | |
|---|---|
| Acrylic thermoplastic resin | 20~23 g (preferably, 21.5 g) |
| Paraffin wax | 3 g or less (preferably, 2.0 g) |
| Atactic polypropylene | 2 g or less (preferably, 1.5 g) |

The mixture is distilled and dried at 130° C. for 24 hours, and thereafter kneaded at 130° C. by a roll mill of alumina into the compound having the desired viscosity.

Subsequently, the compound is injection-molded into a molded body shaped as shown in FIG. 1 by a mold assembly (not shown). The molded body is heated in a nitrogen atmosphere up to a temperature at which the organic binder of the acrylic thermoplastic resin, etc. is thermally decomposed and fully carbonized, so that the molded body is degreased. The specific upper limit temperature up to which the molded body is to be heated in this initial heat treatment may be determined depending on the capability of a heat treatment furnace used and the temperature at which the organic binder is thermally decomposed. In this embodiment, the molded body is heated from room temperature (20° C.) to 450° C. in 72 hours. Other processing conditions are given below. While the molded body is being heated up to 450° C., it is kept under a constant pressure.

| | |
|---|---|
| Processing pressure | 1~8 kg/cm$^2$ (optimum pressure: 8 kg/cm$^2$) |
| TIme required to heat the molded body from 20° C. to 450° C. | 72 hours or shorter |

In the initial heat treatment, the added organic binder composed of an acrylic thermoplastic resin, paraffin wax, and atactic polypropylene is thermally decomposed and carbonized, so that the molded body is degreased.

Then, the molded body (degreased body) is fired in the atmosphere by subsequent heat treatment under conditions given below, thereby producing a fired body. The molded body is heated at a rate of 100° C./hour.

| | |
|---|---|
| Processing temperature | 1200~1300° C. (optimum temperature: 1235° C.) |
| Time during which the molded body is kept at the processing temperature | 0~4 hours (optimum time: 2 hours). |

The molded body is fired by the subsequent heat treatment in the temperature range of from 1200° to 1300° C. for the reasons that the density of the fired molded body will be 95% or more of the theoretical density for being subject to subsequent hot isostatic pressing, and large crystals will not be produced in the fired body. If the molded body were fired at a temperature lower than 1200° C., then the density of the fired molded body would be less than 95% of the theoretical density and the molded body would not be subject to hot isostatic pressing. If the molded body were fired at a temperature higher than 1300° C., then the fired body would have large crystals at a greater frequency, and would not be sufficiently strong.

The molded body is thus fired after it is degreased by the initial heat treatment and the subsequent heat treatment. The volume of the molded body thus fired is reduced such that the volume of the molded body is 82.5% of the volume of the molded body before it is fired. The packing ratio of the fired body is about 100% (bulk density: 3,976). Until the subsequent heat treatment is completed, the bonized material which has been modified in the initial heat treatment is completely burned away.

Thereafter, the fired body is subjected to hot isostatic pressing in an argon atmosphere or an argon atmosphere which contains 20 vol. % or less of oxygen under conditions given below. At this time, the fired body is heated at a rate of 200° C./hour. The fired body thus pressed exhibits a light-transmitting ability.

| | |
|---|---|
| Processing temperature | 1200~1250° C. (optimum temperature: 1230° C.) |
| Processing pressure | 1000~2000 atm (optimum pressure: 1000 atm) |
| Processing time | 1~4 hours (optimum processing time: 2 hours) |

The fired body is subjected to hot isostatic pressing in the above temperature range and pressure range in order to achieve a desired high light-transmitting ability and improve its mechanical strength to avoid damage during the hot isostatic pressing. If the hot isostatic pressing were carried out at a temperature lower than 1200° C. or under a pressure lower than 1000 atm, then although the fired body would be rendered light-transmissive, the obtained light-transmitting ability would be low. If the hot isostatic pressing were carried out at a temperature in excess of 1250° C., then abnormal grain growth would be accelerated, inviting a reduction in the mechanical strength and the light-transmitting ability. If the hot isostatic pressing were carried out under a pressure in excess of 2000 atm, then stresses would concentrate in regions where bores and flaws, even if extremely small, are located in the fired body, tending to cause the fired body to crack in those regions.

Thereafter, the ends of the fired body are ground by a diamond grinding wheel (not shown) to remove edges, thereby completing the light-transmissive bulb 1F of alumina. Specifically, as shown in FIG. 1, the light-transmissive bulb 1F with the electrode holding holes 1*a*, 1*b* defined in its respective opposite ends is fabricated.

The inner and outer surfaces of the bulb 1F thus produced are then ground by a brush with a diamond grinding grain having a particle diameter of 0.5 μm until the bulb 1F will have a wall thickness of 0.2 mm or less. When the inner and outer surfaces of the bulb 1F are thus ground, surface irregularities are removed from the surfaces of the bulb 1F to prevent light from being scattered by the surfaces of the bulb 1F and improve a linear transmittance thereof.

The bulb 1F includes a light-emitting region having an inside diameter of about 4.0 mm, a wall thickness of about 0.3 mm, an entire length of about 40 mm, and has properties given below. As a result of a structural observation using a transmission electron microscope (TEM), no gaps and lattice defects in the grain boundary phase and crystal grains which would be responsible for scattering light were found. The diameter of the electrode holding hole 1*b* is about 1 mm or less.

Linear transmittance with respect to visible light having wavelengths ranging from 380 to 760 nm: 70% or higher Linear transmittance with respect to light having having wavelength of 500 nm: 82% or higher (at a wall thickness: 0.5 mm)

Average particle diameter of crystal grains: about 0.7 μm (maximum particle diameter: 1.4 μm)

Mechanical strength (JIS R1601):

Bending strength St (room temperature)=98 kg/cm$^2$ (900° C.)=81 kg/cm$^2$

Weibull coefficient (room temperature)=9.3

(900° C.)=8.1

In the measurement of the particle diameter and the mechanical strength, there was used a specimen (whose shape, thickness, etc. were according to JIS R1601) fabricated as a substitute for the bulb 1F according to the above embodiment. The specimen was fabricated under the conditions in the above process.

The particle diameter was calculated by lapping, with a diamond grinding grain, the surfaces of the specimen fabricated so that its shape, thickness, etc. were according to JIS R1601, subjecting the specimen to grain boundary etching with dissolved potassium hydroxide, observing the surfaces of the specimen with a scanning electron microscope, and analyzing the image of profiles of crystal grains. In the image analysis, the crystal grains were assumed to be spherical or polygonal in shape, and their diameters and the maximum value of inter-vertex distances were used to calculate particle diameters.

The linear transmittance was measured by lapping the opposite surfaces of the fabricated specimen, 0.5 mm thick, and thereafter determining the linear transmittance with a double-beam spectrophotometer.

Figure 2:
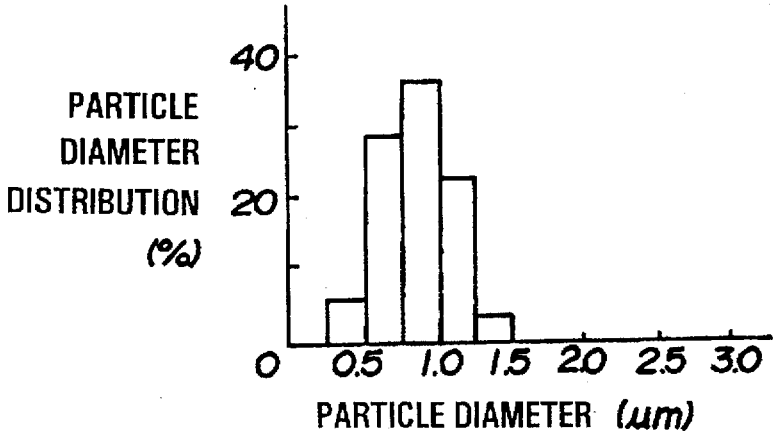
FIG. 2 is a graph showing a particle diameter distribution in light-transmissive alumina used to produce a bulb and a closure of the light-emitting bulb assembly.

The completed bulb 1F made of light-transmissive alumina has smaller crystal grain diameters than general light-transmissive ceramics which are produced by firing alumina with a sintering additive of MgO or the like for greater crystal grains (see FIG. 2).

The bulb 1F fabricated from highly-pure alumina has a light-transmitting ability while having small crystal grain diameters different from those of general light-transmissive ceramics for the following reasons:

Since only a small amount of oxide such as MgO or the like mixed as an impurity (a total of 0.01 mol % or less at maximum) is contained in the powder of alumina, the impurity forms in its entirety a solid solution with alumina, producing almost no grain boundary phase. Therefore, the effect of a grain boundary phase which is responsible for diffusing light in general light-transmissive alumina is eliminated, resulting in an increase in the linear transmittance with respect to visible light.

Furthermore, the following considerations are taken into account:

If it is assumed that all the crystal grains and crystallites have a circular cross section, then a crystal grain having a diameter D and made up of n crystallites each having a diameter d satisfies the following equation ①:

$$n=(D/d)^2$$

The value of n calculated according to the above equation can be converted into crystallite boundaries contained in the cross section of one crystal grain.

The lattice constants of various light-transmissive aluminas obtained from highly pure alumina (having average particle diameters of 0.72, 0.85, 0.99, 1.16, 1.35, 1.52 μm) were determined using an X-ray diffraction apparatus, and the diameters d of the crystallites of the light-transmissive aluminas having the above average particle diameters were calculated from diffraction peaks (012) according to the Scherrer's equation which relates the diameter d of a crystallite to the width of a diffraction line. As a result, it was found that the diameters d of the crystallites were constant irrespective of the sizes of the crystal grains. The Scherrer's equation is given in P. Gallezot, "Catalysis, Science and Technology", vol. 5 p. 221, Springer-Verlag (1984), and P. Scherrer, "Gottinger Nachrichen", 2, 98 (1918).

It can therefore be seen from the above equation (1) that the smaller the diameters D (average particle diameter) of the crystal grains, the fewer the crystallite boundaries in one crystal grain.

Generally, it is considered that when light is applied to a polycrystalline material such as of ceramic, the light is diffused by surfaces where refractive indexes are not continuous, i.e., regions where the arrangement of atoms is discontinuous. Since a crystallite boundary in a crystal grain is nothing but such a region where the arrangement of atoms is discontinuous, it causes a diffusion of light. Consequently, the fewer the crystallite boundaries in a crystal grain, i.e., the smaller the diameter D of a crystal grain, the smaller the effect of the crystallite boundaries which are responsible for diffusing light, giving rise to an increase in the linear transmittance with respect to visible light.

Figure 3:
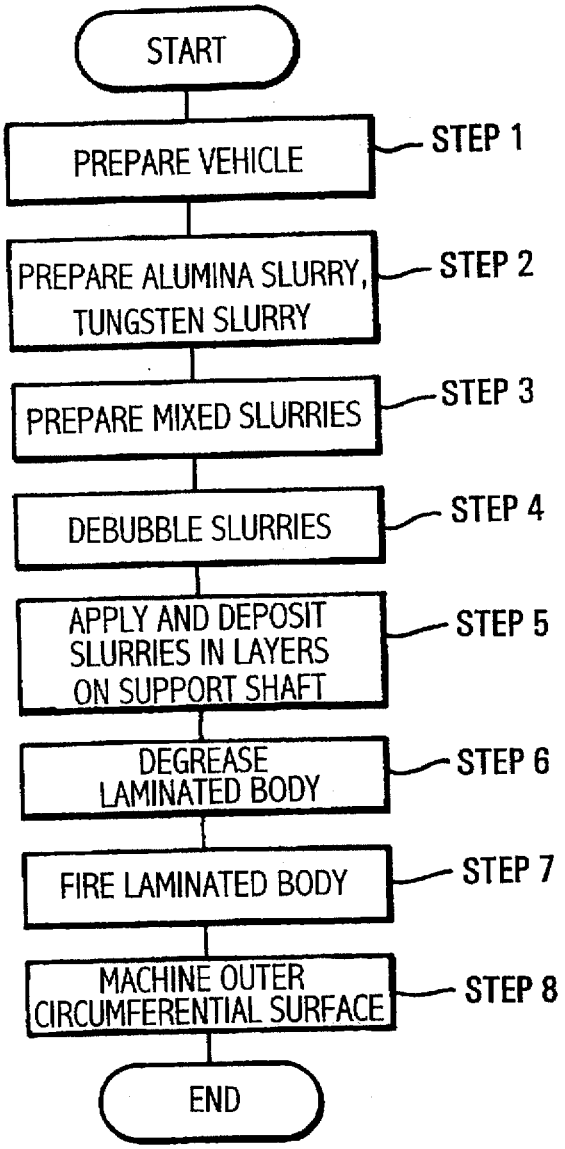
FIG. 3 is a diagram showing a process of manufacturing the closure of the light-emitting bulb assembly.

The closures 2, 2A are manufactured as described below. A process of manufacturing the closures will be described below with reference to FIG. 3.

First, a vehicle to be used to suspend therein the fine powder of alumina (secondary aggregate) synthesized as described above and the fine powder of tungsten is prepared from various organic materials given in Table 1 below (step 1). To prepare the vehicle, the organic materials are weighed and uniformly mixed by a mixer.

TABLE 1

| Ingredients | Volume ratio |
|---|---|
| α-terpineol | 50 |
| butyl acetate carbitol | 20 |
| ethyl cellulose | 3 |
| polyvinyl butyral | 7 |
| ethanol | 10 |

The fine powder of alumina, the prepared vehicle, an organic solvent (butyl diphthalate), and a dispersing agent (ammonium carboxylic acid) are mixed at volume ratios given in Table 2, below, and kneaded into an alumina slurry by three rolls (step 2).

TABLE 2

| Ingredients | Volume ratio |
|---|---|
| fine powder of alumina | 64 |
| vehicle | 32 |
| butyl diphthalate | 3.5 |
| ammonium carboxyl acid | 0.5 |

The fine powder of tungsten, the prepared vehicle, an organic solvent (butyl diphthalate), and a dispersing agent (ammonium carboxylic acid) are mixed at volume ratios given in Table 3, below, and kneaded into a tungsten slurry by three rolls (step 2).

TABLE 3

| Ingredients | Volume ratio |
|---|---|
| fine powder of tungsten | 82 |
| vehicle | 15 |
| butyl diphthalate | 2.6 |
| ammonium carboxyl acid | 0.4 |

Using the alumina slurry prepared at the volume ratios given in Table 2 and the tungsten slurry prepared at the volume ratios given in Table 3, eight slurries composed of tungsten and alumina mixed at volume ratios (tungsten/alumina) given in Table 4, below, are prepared (step 3).

TABLE 4

| Slurries | Volume ratio (tungsten/alumina) |
|---|---|
| 1st layer slurry | 80/20 |
| 2nd layer slurry | 60/40 |
| 3rd layer slurry | 40/60 |
| 4th layer slurry | 30/70 |
| 5th layer slurry | 20/80 |
| 6th layer slurry | 10/90 |
| 7th layer slurry | 5/95 |
| 8th layer slurry | 3/97 |

Each of the mixed slurries thus prepared is sufficiently mixed such that alumina and tungsten are uniformly dispersed, and thereafter debubbled (step 4). More specifically, each of the mixed slurries is put in a resin container in a vacuum desiccator, and air in the vacuum desiccator is drawn out by a vacuum pump for a few tens of minutes (e.g., about 20 minutes) while the slurry in the resin container is being stirred by a magnetic stirrer or the like. While the slurry is being debubbled in vacuum, the organic solvent is partly volatilized to achieve a slurry viscosity of 30,000 cP.

Figure 4:
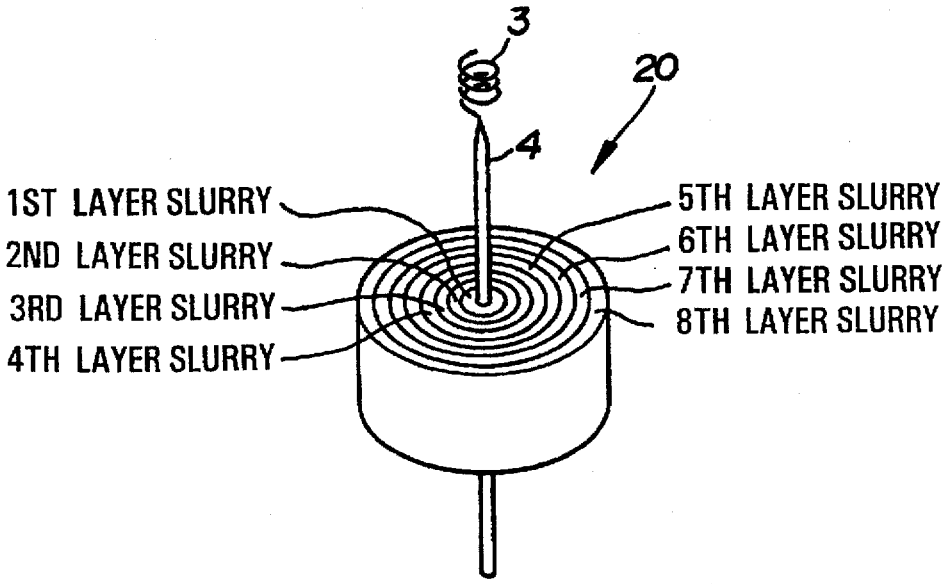
FIG. 4 is a perspective view of the closure.

Then, the mixed slurries shown in Table 4 are concentrically deposited to a predetermined thickness on the outer circumferential surface of each of the support shafts 4 supporting the main electrodes 3, which serves as cores of the closures. The mixed slurries shown in Table 4 are applied in a descending order of volume ratios of tungsten, i.e., from the first layer slurry to the eighth layer slurry. A laminated body 20 as a precursor of each of the closures 2, 2A is thus formed around the support shafts 4 as shown in FIG. 4 (step 5). The mixed slurries are applied to and deposited on the outer circumferential surface of each of the support shafts 4 in the order from the first layer slurry to the eighth layer slurry by coating and drying each of the slurries successively from the first layer slurry.

In this manner, an innermost layer composed of the first layer slurry is formed in a core-side region of the closure which is located adjacent to the core, a plurality of intermediate layers composed of the second through seventh layer slurries are formed in an intermediate region of the closure, and an outermost layer composed of the eighth layer slurry is formed in a bulb-side region of the closure which is located adjacent to the open end of the bulb.

Figure 5A:
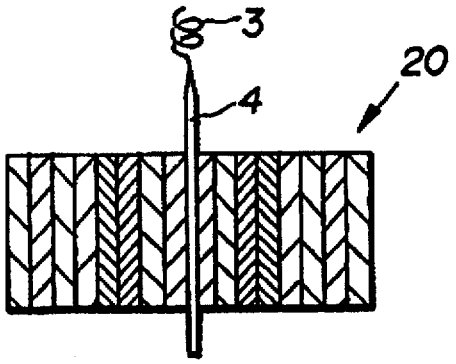
FIGS. 5(*a*) through 5(*c*) are a cross-sectional view showing the structure of the closure and diagrams showing composition distributions of the closure.
Figure 5B:
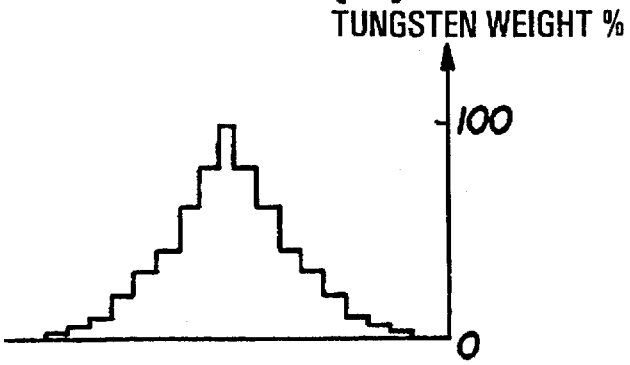
Figure 5C:
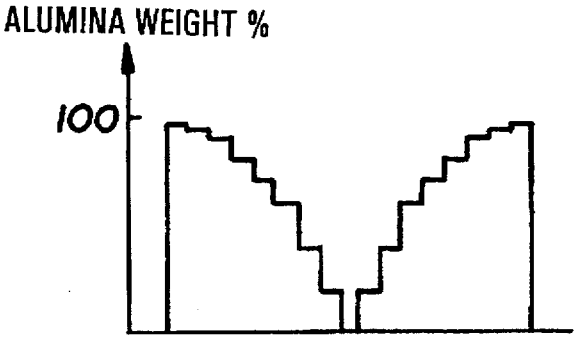

FIGS. 5(*a*), 5(*b*), and 5(*c*) are a cross-sectional view showing the structure of the laminated body and diagrams showing the relationship between volume ratios of tungsten and alumina in each of the layer slurries of the closure. As shown in FIGS. 5(*a*) through 5(*c*), the laminated body 20 is of such1Fcomposition distributions that the volume ratio of alumina increases up to about 100% outwardly from the support shaft 4 as shown in FIG. 5(*c*), and the volume ratio of tungsten decreases from 80% outwardly from the support shaft 4 as shown in FIG. 5(*b*) .

Then, the laminated body 20 is heated to 600° C. for 10 hours in a moisture-containing hydrogen reducing atmosphere, so that the laminated body 20 is degreased (step 6). Specifically, when the laminated body 20 is heated, the organic materials and organic solvent which are contained in the vehicle that were added when the slurries were prepared are thermally decomposed and carbonized, thereby degreasing the formed body.

The degreased laminated body 20 is subsequently heated to 1800° C. for 2 hours in a vacuum atmosphere, so that1Fthe laminated body 20 (degreased body) is fired (step 7). Each of the closures 2, 2A is now obtained as the fired laminated body 20. When this subsequent heat treatment is completed, the carbonized materials modified in the above initial heat treatment are fully burned away.

In each of the layers of the closures 2, 2A, a network structure of crystals is formed between common ingredients by firing, thereby integrally joining the ingredients. A firing process for reducing surface energy is applied to the joining of the closures 2, 2A and the surfaces of the electrode holding holes 1*a*, 1*b* of the bulb 1F to each other. Impurities such as of glass are often added in a small amount in an effort to accelerate the firing process.

More specifically, in the firing process, the alumina forms a solid solution and is crystallized, trapping the powder of tungsten, in each layer of the laminated body 20. Adjacent layers of the laminated body 20 are integrally joined to each other in solid phase as the alumina in the layers forms a solid solution and is crystallized at the mating surfaces of the layers. The support shaft 4 and the innermost layer composed of the first layer slurry are also integrally joined to each other in solid phase because alumina in the innermost layer is crystallized in contact with the support shaft 4, forming a glassy substance in its grain boundaries, and also because tungsten is contained in both the support shaft 4 and the innermost layer. As a result, the fired closures 2, 2A are strongly bonded to the support shafts 4 which support the main electrodes 3, hermetically sealing and securing the support shafts 4 and hence the main electrodes 3 in the bulb 1.

The distribution of coefficients of thermal expansion from the support shaft 4 through the innermost layer and the intermediate layers to the outermost layer is a gradient distribution ranging from the coefficient of thermal expansion of the support shaft 4 (the coefficient of thermal expansion of tungsten) to a coefficient of thermal expansion which is close to the coefficient of thermal expansion of the bulb 1F (the coefficient of thermal expansion of alumina), based on the composition distributions thereof.

After the support shafts 4 have been sealed and secured, the outer circumferential surfaces of the outermost layers of the closures 2, 2A are cut or ground so as to fit in the electrode holding holes 1*a*, 1*b* in the bulb 1F (step 8). The closures are now completed, and the manufacturing process is ended.

Assembling the completed closures 2, 2A into the bulb 1F and fabrication of the light-emitting bulb assembly 1 will be described below.

First, as shown in FIG. 1, the closure 2A (identical to that shown in FIGS. 4 and 5) which has been fired and machined on its outer circumferential surface is fitted in the electrode holding hole 1*b* in the bulb 1F, bringing the outer circumferential surface of the closure 2A into contact with the inner circumferential surface of the electrode holding hole 1*b*. Thereafter, an infrared radiation or high-output laser beam is locally applied to the contacting surfaces to heat them.

The localized heating causes the alumina in the outermost layer composed of the eighth layer slurry of the closure 2A and the alumina in the bulb 1F to be fired and crystallized, and also causes grain boundaries in the joined surfaces to be embedded by a glass phase that is primarily of a structure of spinel, garnet or the like. The closure 2A and the bulb 1F are therefore joined in solid phase to each other. As a consequence, the closure 2A and the bulb 1F are hermetically secured to each other by the formation of a glass phase in the grain boundaries of alumina in the outer-most layer and the bulb 1F.

Similarly, the closure 2 (see FIGS. 4 and 5) which has been fired and machined on its outer circumferential surface is fitted in the electrode holding hole 1*a* in the bulb 1F, and an infrared radiation or high-output laser beam is locally applied to the contacting surfaces to heat them. The closure 2 and the bulb 1F are integrally joined in solid phase to each other. The bulb 1F is now ready for being filled with a starting rare gas metal and a discharging material.

Then, an amalgam of a given starting rare gas metal and a discharging material (an alloy of Sn, Na-Tl-In, Se-Na, Dy-Tl, or a halide of each of the metals) is introduced through the slender introduction tube 1*c* into the bulb 1F whose ends have been sealed, and thereafter the slender introduction tube 1*c* is sealed by the sealant 1*d*.

Since the closures 2, 2A and the bulb 1F are integrally joined in solid phase to each other without use of soldering glass which has heretofore been relied upon, the materials which have been sealed in the bulb 1F are reliably prevented from leaking out.

The bulb 1F with the main electrodes mounted therein are generally incorporated in an outer tube of a high-pressure discharge lamp such as a metal halide lamp or the like.

Light-emitting bulb assemblies (inventive examples) in which the volume ratios of tungsten in the innermost layer or the volume ratios of alumina in the outermost layer of the closure 2 according to the first embodiment are of various values which fall in the range according to the present invention, light-emitting bulb assemblies (comparative examples) in which these volume ratios are of values which fall out of the range according to the present invention, and light-emitting bulb assemblies (conventional examples) in which the closure of alumina is fixed to the bulb by alumina cermet will be compared with each other. Results of the comparison are given in Tables 5 and 6 below. Each of the light-emitting bulb assemblies has a bulb which is identical to the bulb according to the first embodiment of the present invention. The closures have various numbers of layers including innermost, outermost, and intermediate layers. The volume ratios of alumina and tungsten from the innermost layer through the intermediate layers to the outermost layer are of distributions having increasing and decreasing gradients.

The durability of the light-emitting bulb assemblies was evaluated according to an accumulation of energization periods (energization service life) by repeatedly turning them on for 5 hours and turning them off for 0.5 hour for thereby developing thermal stresses in the light-emitting bulb assemblies. Each of the light-emitting bulb assemblies was turned on by a voltage of 100 V (100 W) applied between the main electrodes 3 across a discharging material of Hg—$TlI_3$ (0.11 g) sealed in the bulb. Since the stably energized state becomes greatly unstable in the event of a leakage of the sealed materials, the accumulation of energization periods was interrupted at the time the energized state became unstable.

TABLE 5

| Specimen No. | Type | Tungsten/alumina volume ratio: Innermost layer | Outermost layer | Number of layers | Energization service life |
|---|---|---|---|---|---|
| 1 | Inventive | 55/45 | 3/97 | 7 | 3500 |
| 2 | Inventive | 65/35 | 3/97 | 8 | 4300 |
| 3 | Inventive | 75/25 | 3/97 | 9 | 5200 |
| 4 | Inventive | 85/15 | 3/97 | 10 | 8000 |
| 5 | Comparative | 35/65 | 3/97 | 4 | *1 |
| 6 | Comparative | 45/55 | 35/65 | 3 | 3000 |
| 7 | Conventional | — | — | — | 3000 |

*1 . . . Unable to measure due to a conduction failure.

Similarly, the light-emitting bulbs in which a discharging material of Hg—TlI—NaI—$InI_3$ (0.13 g) was sealed were also compared. Results of the comparison are given in Table 6 below.

TABLE 6

| Specimen No. | Type | Tungsten/alumina volume ratio: Innermost layer | Outermost layer | Number of layers | Energization service life |
|---|---|---|---|---|---|
| 1 | Inventive | 55/45 | 3/97 | 7 | 3400 |
| 2 | Inventive | 65/35 | 3/97 | 8 | 3800 |
| 3 | Inventive | 75/25 | 3/79 | 9 | 4300 |
| 4 | Inventive | 85/15 | 3/97 | 10 | 5000 |
| 5 | Comparative | 35/65 | 3/97 | 4 | *2 |
| 6 | Comparative | 45/55 | 35/65 | 3 | 3000 |
| 7 | Conventional | — | — | — | 3000 |

*2 . . . Unable to measure due to a conduction failure.

It can be seen from the above test results that the light-emitting bulb assembly according to the present invention has very high durability even when repeatedly turned on and off. The light-emitting bulb assembly according to the present invention has increased resistance against thermal stresses because the closures 2, 2A are joined in solid phase which have a gradient coefficient of thermal expansion that is closer to the coefficient of thermal expansion of either the support shafts 4 with the main electrodes 3 on their distal ends or the bulb 1F toward the support shafts 4 and the bulb 1F. Because of such increased resistance against thermal stresses, the light-emitting bulb assembly is capable of highly reliable light emission and has a long service life. The light-emitting bulb assembly can also be made available with ease.

The light-emitting bulb assemblies according to the inventive examples with the discharging material of Hg—$TlI_3$(0.11 g) sealed in the bulb had a luminance of 183,000 nt, and the light-emitting bulb assemblies according to the inventive examples with the discharging material of Hg—TlI—NaI—$InI_3$ (0.13 g) sealed in the bulb had a luminance of 240,000 nt.

Since the bulb 1F according to this embodiment is made of light-transmissive alumina composed of small crystal grains having an average particle diameter of about 0.7 μm and a maximum particle diameter of about 1.4 μm and does not form any grain boundary phase, the mechanical strength (bending strength, Weibull coefficient) in a range from room temperature to a temperature upon discharging is higher than a general bulb assembly of light-transmissive ceramics which are produced by firing alumina with a sintering additive of MgO or the like for greater crystal grains. As a result, the light-emitting bulb assembly with the bulb 1F according to the present embodiment has a reduced wall thickness as well as an increased service life. Inasmuch as the reduced wall thickness lowers the thermal capacity of the light-emitting bulb assembly, allowing the light-emitting bulb assembly to be heated quickly to a desired temperature, the starting time required for the discharging metal component to be evaporated up to a saturated vapor pressure until energization of the bulb assembly becomes stable is shortened.

Inasmuch as no grain boundary phase is formed and crystallite boundaries in crystal grains which are responsible for diffused light are reduced based on small grain diameters, the diffusion of light caused while the light passes through the wall of the bulb 1F is suppressed, and the bulb 1F has high linear transmittance of 70% or more with respect to light (visible light) having a wavelength ranging from 380 to 760 nm (linear transmittance with respect to light having a wavelength of 500nm: 82%, thickness: 0.5 mm). Therefore, a high-pressure discharge lamp having the light-emitting bulb assembly 1 with the bulb 1F has increased luminance.

In addition, since there exists no grain boundary phase unlike the conventional bulb, any erosion of grain boundaries with discharging metal vapor components (ions) is suppressed, thereby preventing the discharging metal vapor components from leaking out of the bulb even though the bulb has a reduced wall thickness. Therefore, the highly luminous discharge lamp can have an increased service life as the discharging metal vapor components are prevented from leaking out of the bulb wall even though the bulb wall has a reduced wall thickness. With the light-emitting bulb assembly 1 according to this embodiment, the electrode holding hole **1*b*** is of a small diameter to reduce the amount of the sealant used for thereby suppressing any erosion of the sealant with the discharging metal vapor components (ions), so that any leakage of the discharging metal vapor components is avoided more reliably.

A second embodiment of the present invention will be described below. Closures of a light-emitting bulb assembly according to the second embodiment are different as to a process of manufacturing them and their structure from the closures of the light-emitting bulb assembly according to the first embodiment. The different process and structure will be described below. Components according to the second embodiment are denoted by reference numerals which are identical to those of the components according to the first embodiment, with a suffix "a".

The materials of the closure **2*a* (see FIG. 14**) according to the second embodiment are also a fine powder of highly pure alumina synthesized by drying an aqueous solution of suspended aluminum salt according to a spray drying process and then thermally decomposing the aluminum salt, and a fine powder of highly pure tungsten.

A process of manufacturing the closure 2*a* according to the second embodiment will be described below with reference to FIG. 6.

Figure 6:
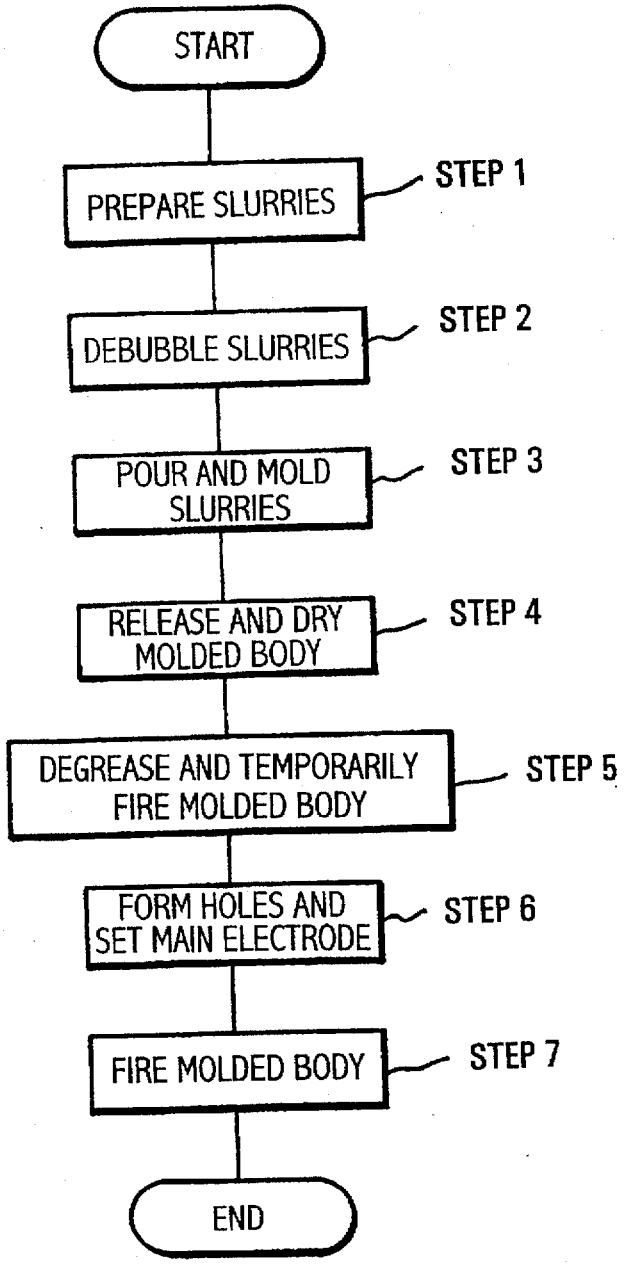
FIG. 6 is a diagram showing a process of manufacturing a closure of a light-emitting bulb assembly according to a second embodiment of the present invention.
Figure 13:
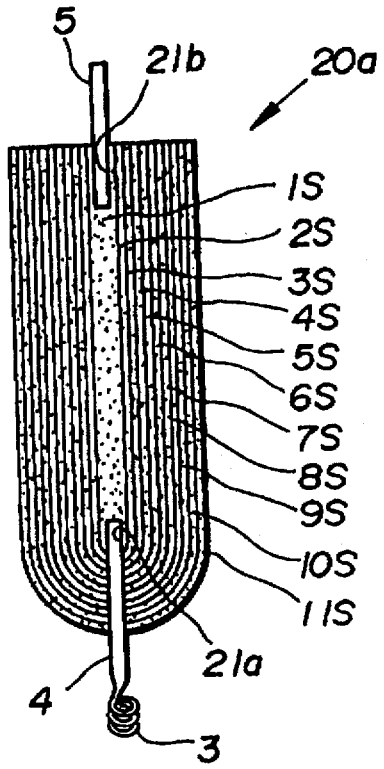
FIG. 13 is a cross-sectional view of the unfired closure with an electrode attached thereto.

As shown in FIGS. 6 and 13, eleven slurries with the following volume ratios of tungsten and alumina (tungsten/alumina) are prepared from a fine powder of alumina and a fine powder of tungsten (step 1):

1st slurry: tungsten/alumina=100/0

2nd slurry: tungsten/alumina=90/10

3rd slurry: tungsten/alumina=80/20

4th slurry: tungsten/alumina=70/30

5th slurry: tungsten/alumina=60/40

6th slurry: tungsten/alumina=50/50

7th slurry: tungsten/alumina=40/60

8th slurry: tungsten/alumina=30/70

9th slurry: tungsten/alumina=20/80

10th slurry: tungsten/alumina=10/90

11th slurry: tungsten/alumina=0/100

The above slurries are prepared as follows: First, the fine powder of alumina and the fine powder of tungsten are weighed such that their volume ratios are of the above numerical values, and a dispersing agent of ammonium carboxylic acid and distilled water are added to the weighed powders. They are then mixed with each other in a wet manner by a ceramic (alumina) ball mill for about 24 hours, so that the fine powders of alumina and tungsten are uniformly present in the solvent while breaking up excessive aggregates.

The ratio (volume ratio) at which the dispersing agent of ammonium carboxylic acid is added to the fine powders in each of the slurries is 2 g with respect to 100 g of the total fine powders in each of the slurries.

Then, each of the slurries is debubbled (step 2). Specifically, each of the slurries taken from the ball mill is put in a resin container in a vacuum desiccator, and air in the vacuum desiccator is drawn out by a vacuum pump for a few tens of minutes (e.g., about 20 minutes) while the slurry in the resin container is stirred by a magnet stirrer or the like.

Figure 7:
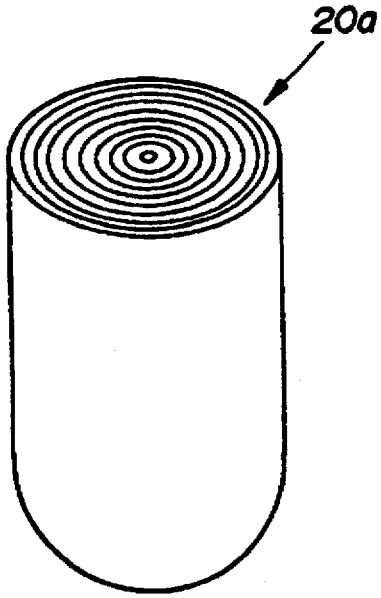
FIG. 7 is a perspective view of an unfired molded body which will be fired into the closure.

Thereafter, a desired molded body 20 *a* shown in FIG. 7 is produced using a mating mold assembly 10 shown in FIG. 8(*a*) according to a process described below. The ratio of vertical and horizontal dimensions of the molded body 20*a*and the closure 2*a*shown in FIGS. 7 and 10(*a*), 10(*b*) is not 1:1 for illustrative purpose.

The mating mold assembly 10 comprises a pair of symmetric molds 11*a*, 11*b* each made of a porous inorganic material such as plaster or the like or a porous resin with minute pores which has substantially the same function as plaster. The molds 11*a*, 11*b* are joined to each other, defining a slurry pouring space 13 between mating surfaces of the molds 11*a*, 11*b* as shown in FIG. 8(*a*).

Figure 8:
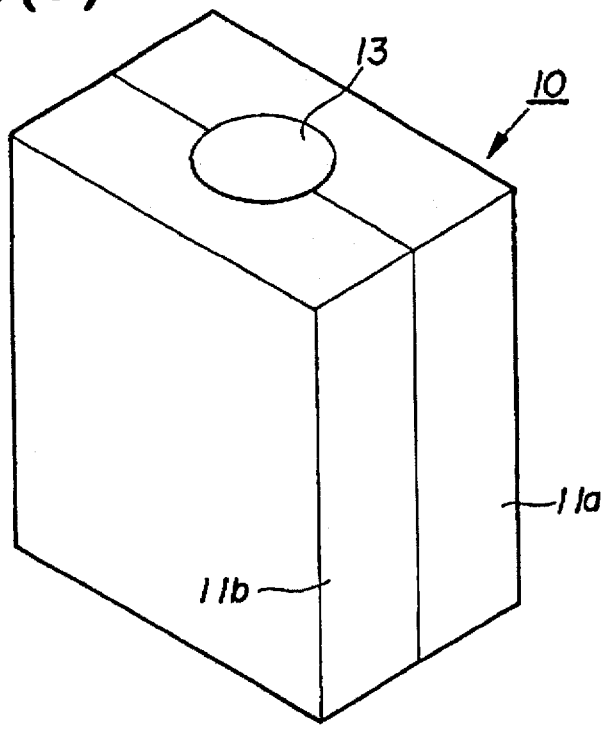
FIGS. 8(*a*) and 8(*b*) are perspective views of a mating mold assembly used to produce the closure.
Figure 8:
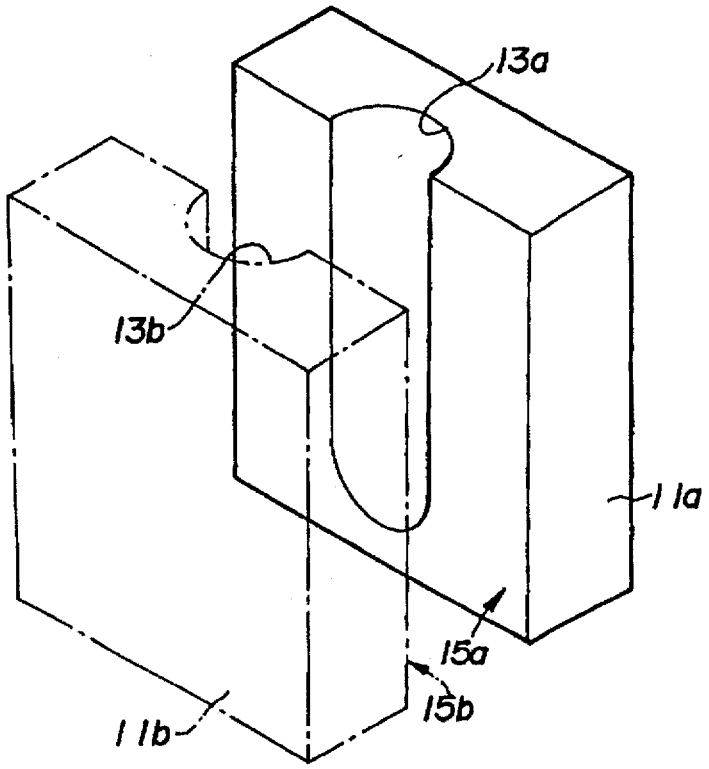

As shown in FIG. 8(*b*) , the molds 11*a*, 11*b* have respective grooves (cavities) 13*a*, 13*b* defined in the respective mating surfaces 15*a*, 15*b* and curved in the vicinity of lower mold ends. The grooves 13*a*, 13*b* are cut in the respective mating surfaces 15*a*, 15*b* by an end mill having a spherical cutter on its distal end. Alternatively, the grooves 13*a*, 13*b* may initially be formed in the respective mating surfaces 15*a*, 15*b*.

Then, the debubbled slurries are poured in a descending order of contents of alumina, i.e., from the eleventh slurry to the first layer slurry, into the slurry pouring space 13 of the mating mold assembly 10 (step 3).

Figure 9:
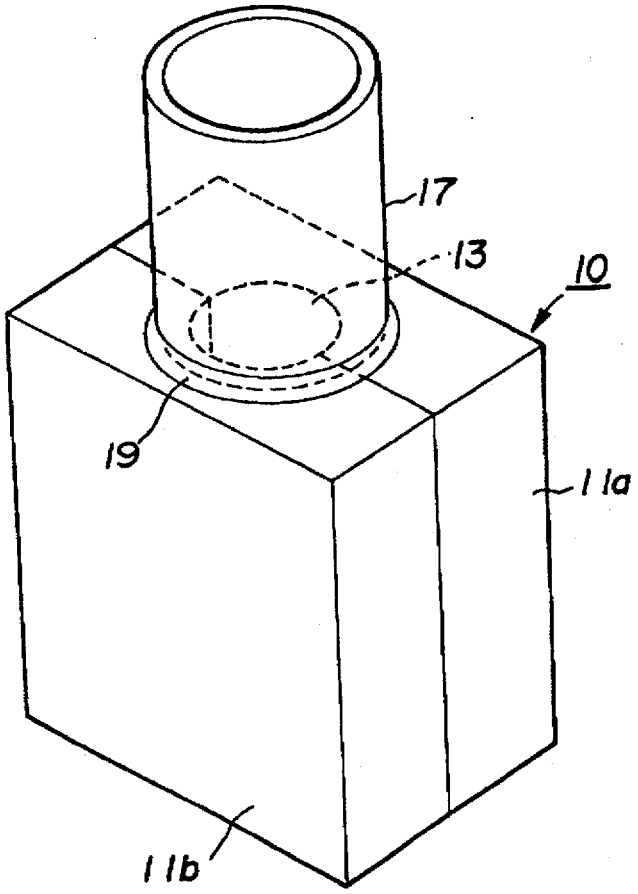
FIG. 9 is a perspective view of the mating mold assembly with an auxiliary member attached thereto.

Specifically, as shown in FIG. 9, a cylindrical member 17 is placed on the upper surface of the mating mold assembly 10, and the eleventh slurry, which is of an amount greater than the volume of the slurry pouring space 13, is poured into the cylindrical member 17. An annular piece of clay 19 is applied to the lower end of the cylindrical member 17 to provide a seal between the lower surface of the cylindrical member 17 and the upper surface of the mating mold assembly 10. The clay may be replaced with rubber.

Figure 10A:
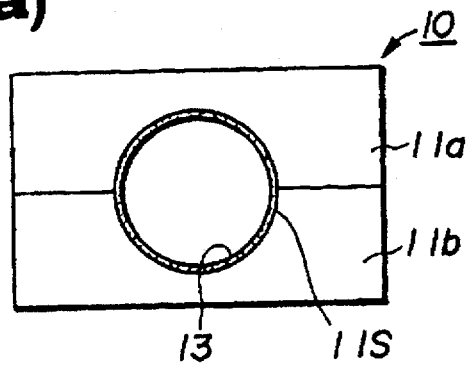
FIGS. 10(*a*) and 10(*b*) are views illustrative of a process of manufacturing the closure.
Figure 10B:
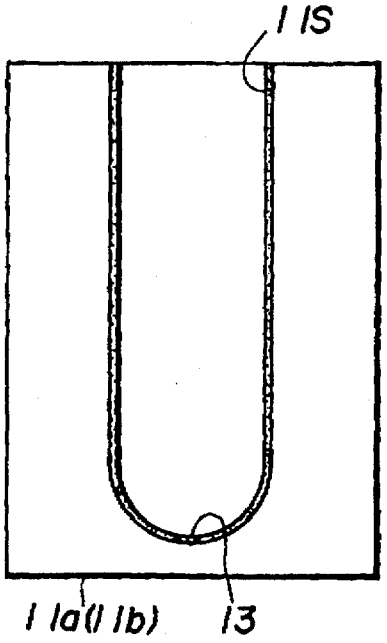
Figure 11:
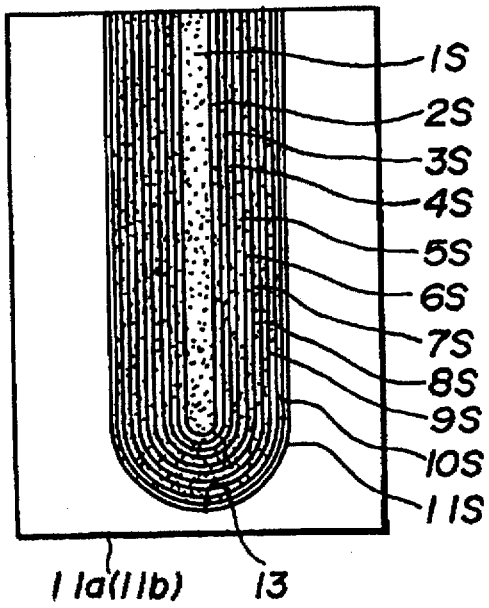
FIG. 11 is a cross-sectional view of the closure which is molded in the mating mold assembly.

After the eleventh slurry has been poured into the slurry pouring space 13, the poured eleventh slurry is left for a predetermined period of time. During this time, the solvent (distilled water) of the eleventh slurry is drawn into the pores of the porous molds 11*a*, 11*b* by capillary action. Accordingly, a powder (alumina powder in the eleventh slurry) bounded by the dispersing agent of ammonium carboxylic acid is uniformly deposited on the wall surface of the slurry pouring surface 13, forming a thin layer 11S thereon as shown in FIGS. 10(*a*) and 10(*b*).

The period of time during which the poured eleventh slurry is left after the eleventh slurry has been poured into the slurry pouring space 13 governs the thickness of the thin layer 11S. The period of time during which the poured eleventh slurry is left is experimentally determined so that the formed thin layer 11S has a predetermined value. The period of time during which the poured eleventh slurry is left and the slurry pouring space 13 are determined also in view of volume shrinkage after firing. The period of time during which the poured eleventh slurry is left according to this embodiment is adjusted so that the formed thin layer 11S has a predetermined value.

While the poured eleventh slurry is being left, a negative pressure may be maintained outside of the molds for forcibly drawing the solvent of the slurry out of the molds. This allows the poured eleventh slurry to be left for a shorter period of time, permits the slurry to be directly debubbled through the molds, and also makes it possible to increase the filling ratio by strongly drawing the solvent.

After the poured eleventh slurry has been left for the predetermined period of time, the eleventh slurry remaining inside the cylindrical member 17 and on the inner surface of the thin layer 11S is discharged. Then, tenth slurry is poured, left for a predetermined period of time, and discharged. Thereafter, the ninth through first slurries are also poured, left for a predetermined period of time, and discharged. After the eleventh through first slurries are repeatedly poured, left for a predetermined period of time, and discharged, the powders in the slurries (the power of alumina alone, the powder of mixed alumina and tungsten, and the powder of tungsten alone) are uniformly deposited in layers, forming thin layers 11S, 10S, 9S, . . . , 1S successively on the wall surface of the slurry pouring space 13. These thin layers 11S, 10S, 9S, . . . , 1S jointly form a molded body 20*a* as a precursor of the closure 2*a*.

Figure 12A:
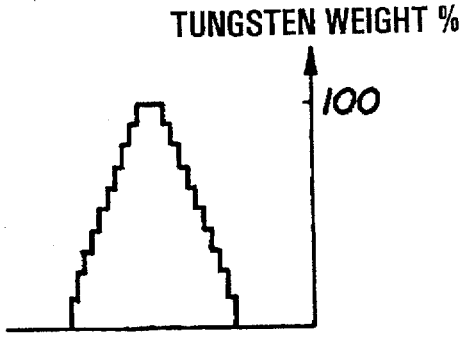
FIGS. 12(*a*) and 12(*b*) are diagrams showing composition distributions of the closure.
Figure 12B:
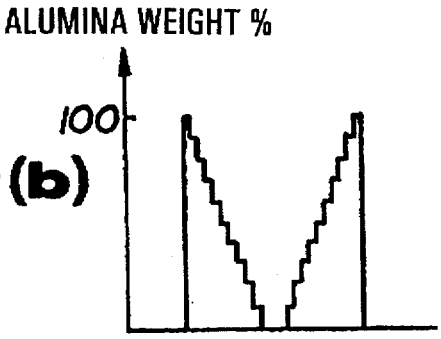

FIGS. 12(*a*) and 12(*b*) are diagrams showing the relationship between volume ratios of tungsten and alumina in each of the thin layers. As shown in FIGS. 12(*a*) and 12(*b*) , the molded body 20*a* is of such composition distributions that the volume ratio of alumina increases from 0% up to 100% from the central thin layer 1S toward the outer thin layers as shown in FIG. 12(*b*) , and the volume ratio of tungsten creases from 100% to 0% from the central thin layer 1S toward the outer thin layers as shown in FIG. 12(*a*). The thin layer 2S in the molded body 20*a* corresponds to the innermost layer (or the core-side layer) of the laminated body 20 according to the preceding embodiment, the thin layer 11S corresponds to the outermost layer (or the bulb-side layer) of the laminated body 20 according to the preceding embodiment, and the thin layers 3S~10S correspond to the intermediate layers of the laminated body 20 according to the preceding embodiment. The thin layers 2S~10S are disposed around and covers the central layer 1S.

When the cycles of pouring, leaving for a predetermined period of time, and discharging the eleventh through first slurries are completed, the mating mold assembly 10 is separated, releasing the molded body 20*a* shaped as shown in FIG. 7. The molded body 20*a* is dried until the solvent is thoroughly removed therefrom (step 4).

Thereafter, the molded body 20*a* is heated to 600° C. for 10 hours in a moisture-containing hydrogen reducing atmosphere, so that the molded body 20*a* is degreased and temporarily fired (step 5). Specifically, when the molded body 20*a* is heated, the dispersing agent which was added when the slurries were prepared is thermally decomposed, thereby degreasing the molded body 20*a*.

Then, as shown in FIG. 13, support holding holes 21*a*, 21*b* are defined respectively in the opposite ends of the molded body 20*a*, and a support shaft 4 which supports a main electrode 3 is fitted in the support holding hole 21*a* that is defined in the distal end of the central layer 1S, and a shaft 5 of tungsten is fitted in the support holding hole 2l*b*, thereby setting the main electrode 3 (step 6).

The molded body 20*a* with the main electrode 3 set is subsequently heated to 1500° C. for 2 hours in a vacuum atmosphere, so that the molded body 20*a* is fired (step 7). The closure 2*a* is now obtained as the fired molded body 20*a*. Until this subsequent heat treatment is completed, the carbonized materials modified when the molded body is degreased are fully burned away.

In the firing process, the thin layers of the molded body 20*a* are integrally joined in solid phase as with the laminated body 20*a* according to the preceding embodiment. The support shaft 4, the shaft 5, and the thin layer 1S are also integrally joined in solid phase by volume shrinkage upon firing and coexistence of tungsten. As a result, the fired closure 2*a* is firmly bonded to the support shaft 4 which supports the main electrode 3 and the shaft 5, hermetically sealing and securing the support shaft 4 and the main electrode 3. The closure 2*a* is now completed, and the process of manufacturing same is completed in its entirety.

The outside diameter of the fired closure 2*a* is determined by the diameter of the slurry pouring space 13 which takes into account volume shrinkage upon firing. Therefore, the fired closure 2*a* is not required to be machined at its outer circumferential surface.

The distribution of coefficients of thermal expansion from the support shaft 4 through the thin layers 2S through 9S to the thin layer 10S is a gradient distribution ranging from the coefficient of thermal expansion of the support shaft 4 (the coefficient of thermal expansion of tungsten) to the coefficient of thermal expansion of the bulb 1F (the coefficient of thermal expansion of alumina), based on the composition distributions thereof.

Figure 14:
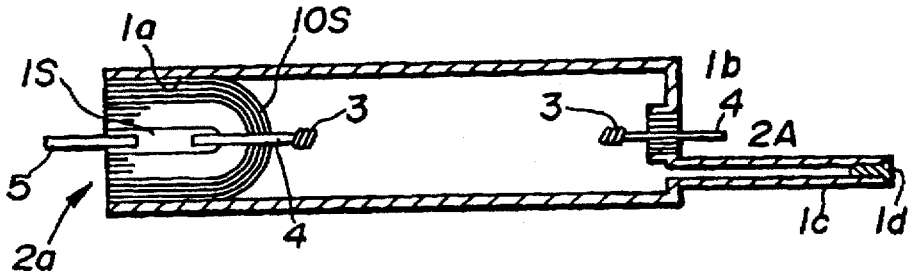
FIG. 14 is a cross-sectional view of the closure as it is mounted in a bulb.

As shown in FIG. 14, the completed closure 2*a* is fitted in the electrode holding hole 1*a* in the bulb 1F, and then an infrared radiation or high-output laser beam is locally applied to the contacting surfaces of the closure 2*a* and the bulb 1F to heat them.

The localized heating causes the alumina in the thin layer 10S of the closure 2*a* and the alumina in the bulb 1F to form a glass phase in the grain boundaries in the joined surfaces. The closure 2*a* and the bulb 1F are therefore joined in solid phase to each other. As a consequence, the closure 2*a* and the bulb 1F are hermetically secured to each other. Then, a starting rare gas metal and a discharging material are filled in the bulb 1F. The light-emitting bulb assembly shown in FIG. 14 is now completed.

The light-emitting bulb assembly with the closure 2*a* was also measured for its energization service life when repeatedly turned on and off. As a result, it was found that the light-emitting bulb assembly with the closure 2*a* also had very high durability as with the light-emitting bulb assembly with the closure 2. The light-emitting bulb assembly with the closure 2*a* has increased resistance against thermal stresses because the closure 2*a* has a gradient coefficient of thermal expansion that is closer to the coefficient of thermal expansion of either the support shaft 4 having the main electrode 3 or the bulb 1F toward the support shaft 4 and the bulb 1F. Because of such increased resistance against thermal stresses, the light-emitting bulb assembly is capable of highly reliable light emission and has a long service life. The light-emitting bulb assembly can also be made with ease.

The light-emitting bulb assembly with the closure 2*a* also offers the following advantages:

Since the volume ratio of alumina is 100% in the thin layer 11S which is exposed in the bulb 1F in supporting the main electrode 3 in the bulb 1F, i.e., the thin layer 11S is an insulation, back arcs from the main electrode 3 can be avoided for more stable energization of the light-emitting bulb assembly.

Because the main electrode 3 and the shaft 5 which serves as an external terminal are hermetically sealed by the thin layer (central layer) 1S whose volume ratio of tungsten is 100%, a desired voltage can be applied to the main electrode 3 without fail.

In addition, as the thin layers are formed by pouring slurries, it is possible to achieve uniform thicknesses of the thin layers for reliably maintaining composition distributions in the layers and a gradient distribution of coefficients of thermal expansion.

While the two embodiments of the present invention have been described above, the present invention is not limited to these embodiments, but various changes and modifications may be made therein without departing from the scope of the present invention.

The materials of the bulb 1F, the closure 2, and the closure 2*a* include a fine powder of alumina whose purity is 99.99 mol % or higher in the above embodiments. However, insofar as the bulb 1F has practical linear transmittance (linear transmittance with respect to light having a wavelength ranging from 380 to 760 nm), the material is not limited to such a fine powder of alumina.

For example, the bulb 1F may be in the form of a fired body composed primarily of an oxide such as alumina, magnesia, zirconia, yttria or silica and a nitride such as aluminum nitride, with a compound (sintering additive) added for suppressing abnormal grain growth and accelerating firing. The closures 2, 2*a* may be fabricated using the same fine powder of ceramic as the bulb 1F thus produced. Specifically, the bulb 1F may be made of a fine powder of alumina having a purity of 99.2 mol % and an average particle diameter ranging from 0.3 to 1.0 μm, and the closures 2, 2*a* may be made of such a fine powder of alumina and a fine powder of tungsten.

While the materials of the closures 2, 2*a* include a fine powder of tungsten in the above embodiments, the materials of the closures 2, 2*a* may be modified depending on the material of the support shaft 4 which serves as a core. For example, if the support shaft 4 is made of niobium or molybdenum, then the materials of the closures 2, 2*a* may include a fine powder of niobium or molybdenum.

The bulb may be of any of various shapes. For example, rather than having the larger-diameter electrode holding hole 1*a* and the smaller-diameter electrode holding hole 1*b*which are defined respectively in the opposite ends of the bulb 1F, the bulb may be of a cylindrical shape with its both ends being simply open or may be a curved bulb.

In the fabrication process according to the first embodiment, each of the mixed slurries is coated and dried in forming the laminated body 20 around the support shaft 4 of tungsten which supports the main electrode 3. However, green sheets may be produced from the respective mixed slurries, and successively wound around the support shaft 4 in a descending order of volume ratios of tungsten. In this case, it is preferable to stack the green sheets such that the joined surfaces of the green sheets are alternately staggered 180° around the support shaft.

In joining the closures 2, 2*a* and the bulb 1F to each other in solid phase, the contacting surfaces are locally heated. However, they may be heated in the vicinity of the support shaft 4. Even when they are heated in the vicinity of the support shaft 4, since the applied thermal energy is transmitted to the outermost layers of the closures 2, 2*a*, the closures 2, 2*a* and the bulb 1F can be joined to each other in solid phase. The closures 2, 2*a* may be fired while the degreased closures 2, 2*a* are being assembled in the bulb 1F.

Figure 15:
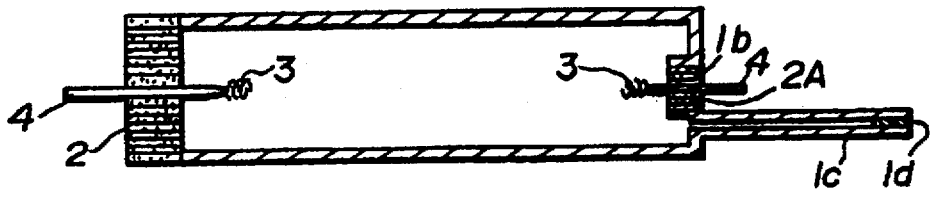
FIG. 15 is a cross-sectional view of a light-emitting bulb assembly according to a modification of the first embodiment.

The closure 2 is assembled in the bulb 1F by being fitted in the electrode holding hole 1*a*. Instead, as shown in FIG. 15, the closure 2 may be held against an open end of the bulb 1F to bring the end of the bulb 1F into contact with the side of the outermost layer of the closure 2, and the contacting surfaces may be locally heated to join the closure 2 and the bulb 1F to each other in solid phase at their ends.

The gradient of the volume ratios of alumina and tungsten in the mixed slurries is not limited to the values indicated in the above embodiments, but may be of any of various other values.

The closure 2 may be made of a gradient function material whose compositional proportions vary linearly from the core toward the bulb.

As used herein the language "gradient function material" refers to a material having compositional proportions which vary gradually therethrough from a compositional proportion which is the same or substantially the same as that of the core to a compositional proportion which is the same or substantially the same as that of the bulb, and which correspondingly has a gradient distribution of coefficients of thermal expansion therethrough ranging from one which is the same or substantially the same as that of the core to one which is the same or substantially the same as that of the bulb.

The first and second embodiments described above offer the following advantages:

In the light-emitting bulb assemblies according to the first and second embodiments, the closure joined in solid phase to the opening of the bulb which is made of light-transmissive ceramic comprises a multilayer laminated body, and the distribution of coefficients of thermal expansion from the innermost layer near the central conductive core toward the outermost layer near the bulb is a gradient distribution ranging from the coefficient of thermal expansion of the conductive core toward the coefficient of thermal expansion of the bulb based on the gradient of composition ratios of the layers.

Therefore, the compositions of the layers may be of a gradient pattern, and the layers, and the closure and the bulb may be firmly hermetically joined to each other in solid phase.

Based on the gradient distribution of the coefficients of thermal expansion, the concentration of thermal stresses produced upon energization of the bulb assembly can be reduced to avoid cracks in the solid-phase joints. As a result, the materials sealed in the bulb assembly are prevented from leaking out, so that the bulb assembly is capable of highly reliable light emission and has a prolonged service life.

The light-emitting bulb assemblies according to the above embodiments have a bulb made of light-transmissive alumina having an average particle diameter of 1 μm or less and a maximum particle diameter of 2 μm or less. Consequently, the mechanical strength of the light-emitting bulb assemblies ranging from normal temperature to a discharging temperature is higher than that of the conventional light-emitting bulb assemblies. Therefore, the wall thickness of the light-emitting bulb assemblies can be reduced to 0.2 mm or smaller, which is about ⅓ of that of the conventional light-emitting bulb assemblies.

Since almost no grain boundary phase such as a spinel phase is formed and crystallite boundaries in crystal grains which are responsible for diffusing light are reduced based on the small particle diameter, diffusion of light while the light is passing through the wall of the bulb is suppressed, thus providing high linear transmittance with respect to light (visible light) having a wavelength ranging from 380 to 760 nm. Consequently, the amount of light transmitted from a high-luminance discharge light-emitting bulb assembly according to the invention is greater than that from a conventional light-emitting bulb assembly, and hence the luminance of a high-pressure discharge lamp which employs a high-luminance discharge light-emitting bulb assembly according to the invention is increased. That is, the amount of light transmitted from a high-luminance discharge light-emitting bulb assembly at the time light is applied to the high-luminance discharge light-emitting bulb assembly is made substantially equal to the amount of light applied to the high-luminance discharge light-emitting bulb assembly by suppressing diffusion of light. The luminance can further be increased by thinning out the wall of the bulb.

Inasmuch as the closure is fired and fabricated of highly pure alumina, the mechanical strength of the closure is increased, and the durability of the light-emitting bulb assembly as a whole is also increased.

According to the processes of manufacturing the light-emitting bulb assemblies according to the first and second embodiments, a plurality of suspensions with different volume ratios are prepared, a laminated closure having a gradient distribution of coefficients of thermal expansion is fabricated using the prepared suspensions, and the closure and a bulb are firmly hermetically joined in solid phase to each other. Thus, a light-emitting bulb assembly which is highly reliable and has a long service life can easily be manufactured. A laminated closure having a gradient distribution of coefficients of thermal expansion may separately be fired and fabricated, and joined in solid phase to a bulb.

According to the process of manufacturing the light-emitting bulb assembly according to the first embodiment, layers are successively stacked in a descending order of volume ratios of a conductive component by a simple process of coating the layers or the like, for thereby easily producing an unfired laminated body which is a precursor of a laminated closure having a gradient distribution of coefficients of thermal expansion.

The suspensions with different volume ratios are formed into respective green sheets, and layers are successively stacked in a descending order of volume ratios of a conductive component (or a core) by a simple process of winding the green sheets, for thereby easily producing an unfired laminated body which is a precursor of a laminated closure having a gradient distribution of coefficients of thermal expansion.

According to the process of manufacturing the light-emitting bulb assembly according to the second embodiment, thin layers are successively stacked In an order of volume ratios of a conductive component (or a core) by repeating a simple process of pouring a suspension into a porous mold assembly, causing the solvent to penetrate into the mold assembly, and discharging the excessive suspension, for thereby easily producing an unfired laminated body which is a precursor of a laminated closure having a gradient distribution of coefficients of thermal expansion. The thicknesses of the thin layers can be achieved uniformly for reliably maintaining composition distributions in the layers and a gradient distribution of coefficients of thermal expansion.

The central layer capable of being connected to an external source is formed of the conductive component within the innermost layer of the closure, and a given voltage can be applied without fail through the central layer to the main electrode.

A sealing structure of a light-emitting bulb assembly according to a third embodiment of the present invention and a method of manufacturing such a sealing structure will be described below with reference to FIGS. 16 through 19.

Figure 16:
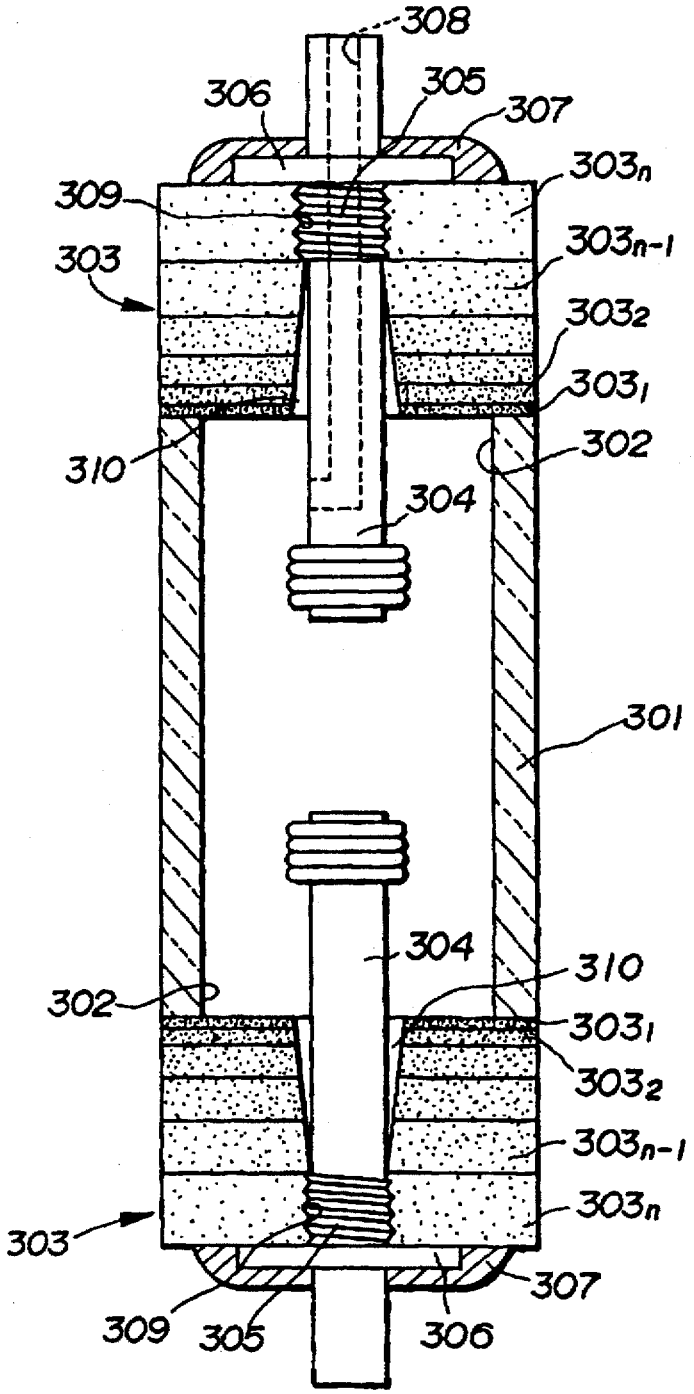
FIG. 16 is a cross-sectional view of a light-emitting bulb assembly according to a third embodiment of the present invention.

FIG. 16 is a cross-sectional view of a light-emitting bulb assembly according to the third embodiment of the present invention, particularly showing in detail a sealing structure of a bulb incorporated in an outer tube of a metal vapor discharge lamp.

A bulb 301 has openings 302 defined respectively in its opposite ends. End caps 303 as closures are integrally attached to the respective open ends 302, and electrode rods 304 as cores of the closures extend through and are held by the end caps 303, respectively.

The bulb 301 is made of light-transmissive polycrystalline alumina, and the electrode rods 304 are made of a tungsten-base material of W/Th or the like which is highly resistant to light-emitting substances. Each of the electrode rods 304 has an externally threaded portion 305 threaded in the corresponding end cap 303 and a flange 306 held against an outer end surface of the end cap 303. The flange 306 has an outer surface sealed by a sealant 307 such as of platinum solder or glass, and one of the electrode rods 304 has a hole 308 defined therein for introducing amalgam.

Each of the end caps 303 is of a multilayer structure as with the above embodiments. More specifically, each of the end caps 303 is composed of a plurality of layers $\mathbf{303}_1$, $\mathbf{303}_2$, . . . , $\mathbf{303}_n$ arranged along the axial direction of the bulb 1. The layer $\mathbf{303}_1$ (the bulb-side region layer) joined to the open end 302 of the bulb 301 has a coefficient of thermal expansion which is substantially the same as that of the light-transmissive alumina of which the bulb 301 is made. The outermost layer $\mathbf{303}_n$ (the core-side region layer) has an internally threaded surface 309 in which the externally threaded portion 305 of the electrode rod 304 is threaded. The outermost layer $\mathbf{303}_n$ has a coefficient of thermal expansion which is substantially the same as that of the electrode rod 304. The compositional proportions of the intermediate layers $\mathbf{303}_2$, . . . , $\mathbf{303}_{-1}$ (intermediate region layers) interposed between the layers $\mathbf{303}_1$, $\mathbf{303}_n$ are adjusted such that the intermediate layers $\mathbf{303}_2$, . . . , $\mathbf{303}_{-1}$ have respective coefficients of thermal expansion varying gradually from that of the innermost layer $\mathbf{303}_1$ toward that of the outermost layer $\mathbf{303}_n$.

The thicknesses of the respective layers increase progressively from the innermost layer $\mathbf{303}_1$ toward the outermost layer $\mathbf{303}_n$. This is effective to reducing stresses that are developed when the layers are thermally expanded.

A tapered gap 310 is defined between the electrode rod 304 and the layers $\mathbf{303}_1$, . . . , $\mathbf{303}_{-1}$ except the outermost layer $\mathbf{303}_n$. The tapered gap 310 prevents the layers $\mathbf{303}_1$, . . . , $\mathbf{303}_{-1}$ from contacting the electrode rod 304 when the lamp is assembled.

Figure 17:
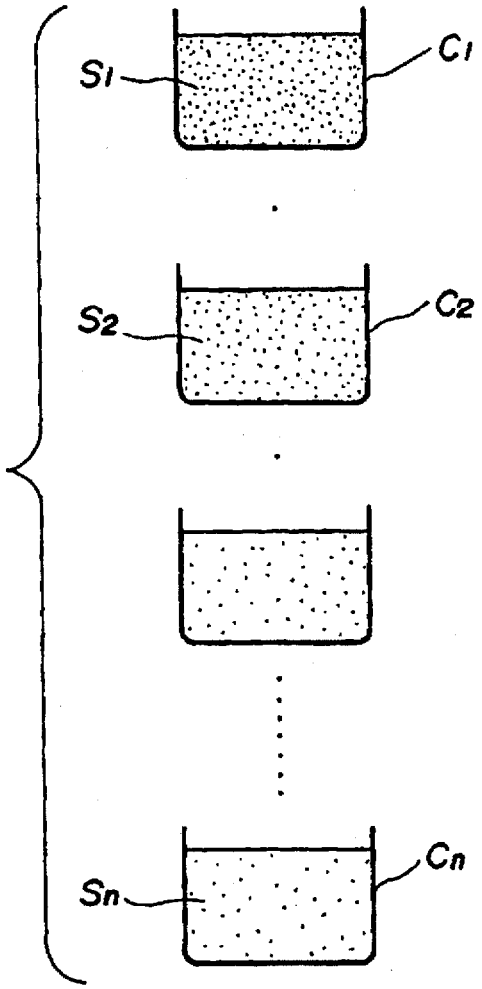
FIG. 17 is a diagram showing a process of preparing a slip for a closure of the light-emitting bulb assembly.

A process of manufacturing the light-emitting bulb assembly of the above structure for a metal vapor discharge lamp will be described below with reference to FIGS. 17 and 18(*a*) through 18(*e*).

First, slips for fabricating the end caps 303 are prepared. To prepare such slips, as many containers $C_1$ . . . $C_n$ as the number (n) of layers of each of the end caps 303 are employed as shown in FIG. 17. Material powders are weighed for obtaining desired coefficients of thermal expansion, and distilled water, a commercially available dispersing agent and a binder are added to the weighed material powders. They are then uniformly mixed for 24 hours by a ball mill, thereby producing slips $S_1$ . . . $S_n$ respectively in the containers $C_1$ . . . $C_n$.

Table 7, given below, shows compositional proportions of material powders of respective slips for an end cap 303 which is composed of a total of eleven layers. In Table 7, the compostional proportions are represented by weight %, and the slip No. corresponds to the number of a layer of the end cap 303.

TABLE 7

| Slip No. | $Al_2O_3$ | W | Ni |
|---|---|---|---|
| 1 | 100 | 0 | 0 |
| 2 | 90 | 9 | 1 |
| 3 | 80 | 18 | 2 |
| 4 | 70 | 27 | 3 |
| 5 | 60 | 36 | 4 |
| 6 | 50 | 45 | 5 |
| 7 | 40 | 54 | 6 |
| 8 | 30 | 63 | 7 |
| 9 | 20 | 72 | 8 |
| 10 | 10 | 81 | 9 |
| 11 | 0 | 90 | 10 |

Then, as shown in FIG. 18(*a*), a tubular mold 312 is set on a porous plate or plaster board 311, and the slips $S_1$ . . . $S_n$ prepared as described above are successively poured into the mold 312, thereby molding a laminated body. When each of the slips $S_1$ . . . $S_n$ is to be poured, it is poured after the previously poured slip has lost its water content to a certain extent so that they will not be mixed with each other and the solvent of the previously poured slip will penetrate into the board 311.

As shown in FIG. 18(*b*), a mold bar 313 may be set either before or after the slips are poured when the laminated body is partly dried, the laminated body is removed from the mold 312. The removed laminated body serves as an end cap 303 with a tapered through hole 314 defined therein as shown in FIG. 18(*c*). The through hole 314 may be of a stepped shape as shown in FIG. 18(*d*).

A bulb 301 molded of a pure alumina slip is prepared, and the end cap 303 which is made wet is joined to an end of the bulb 301 as shown in FIG. 18(*e*), after which the bulb 301 and the end cap 303 are dried. At this time, the bulb 301 and the end cap 303 are unfired, and the bulb 301 is not light-transmissive.

Then, the bulb 301 and the end cap 303 are degreased at 600° C. for 5 hours in a moisture-containing hydrogen reducing atmosphere, and then fired at 1300° C. for 5 hours in a dry hydrogen reducing atmosphere. Thereafter, the produced fired body is subjected to HIP in an argon atmosphere, and then annealed at 1150° C. in a dry hydrogen reducing atmosphere, thereby producing an integral body of the light-transmissive bulb 301 and the end cap 303.

The hole 314 defined in the end cap 303 is tapped to produce an internally threaded surface 309, and then an electrode rod 304 is inserted and an externally threaded portion 305 of the electrode rod 304 and threaded in the internally threaded surface 309. Finally, the electrode rod 304 is fixed and sealed by a platinum solder 307, and an amalgam introduced into the bulb 301 through a hole 308 defined in the electrode rod 304 by a jig in the form of a platinum pipe. In this manner, the lamp is completed.

While the bulb and the end cap are simultaneously fired in the illustrated embodiment, they may be separately fired and then joined to each other. According to such a modification, the bulb of alumina may be degreased and fired in the atmosphere, then subjected to HIP, and thereafter annealed into a light-transmissive bulb of alumina. The end cap which is fired in the same manner as described above may not be subjected to HIP and annealed. The bulb and the end cap may be joined to each other by laser heating in vacuum or at 2000° C. or higher, or using glass having the same coefficient of thermal expansion as alumina. The glass should preferably be melted high-melting-point glass of a high softening point of 900° C. or higher.

The end cap may be formed by a doctor blade process or an injection molding process as well as the slip casting process.

In the doctor blade process, prepared slurries are formed into tapes of desired thicknesses, and the tapes are integrally joined together into an end cap having a gradient function by thermal compression. The same slurries may be used to cast the bulb or poured into a mold and then solidified into the bulb.

In the injection molding process, sheets of desired thicknesses are formed and bonded together with heat, thus producing an end cap which will be joined to a previously molded bulb by thermal compression.

According to the third embodiment, each of the end caps which seal the open ends of a metal vapor discharge lamp is of a multilayer structure, and the coefficients of thermal expansion of the layers vary gradually from the open end of the bulb toward the core which holds an electrode, so that the end caps have a gradient function. Consequently, the end caps are effective to prevent damage due to different thermal expansions and leakage of the metal vapor sealed in the bulb.

Figure 19:
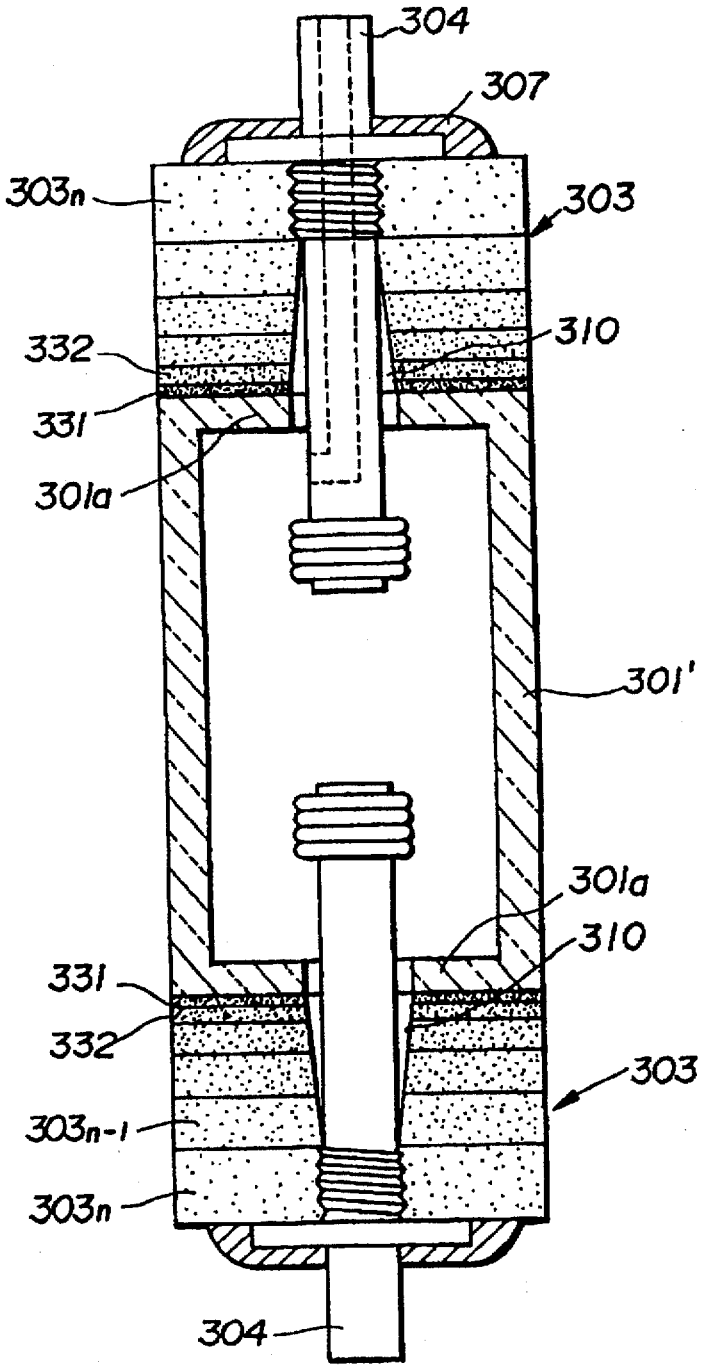
FIG. 19 is a cross-sectional view of a light-emitting bulb assembly according to a modification of the third embodiment.

FIG. 19 shows a modification of the third embodiment. According to the modification, a bulb 301' differs from the bulb 301 shown in FIG. 16 in that the opposite ends of the bulb are not fully open, but have respective end surfaces 301*a*. The end surfaces 301*a* have respective small openings as large as a larger-diameter portion of the tapered through hole 314 for allowing the electrode rods 304 to be inserted therethrough into the bulb.

Light-emitting bulb assemblies according to fourth and fifth embodiments will be described below with reference to FIGS. 20 through 27(*a*) and 27(*b*) .

Figure 20:
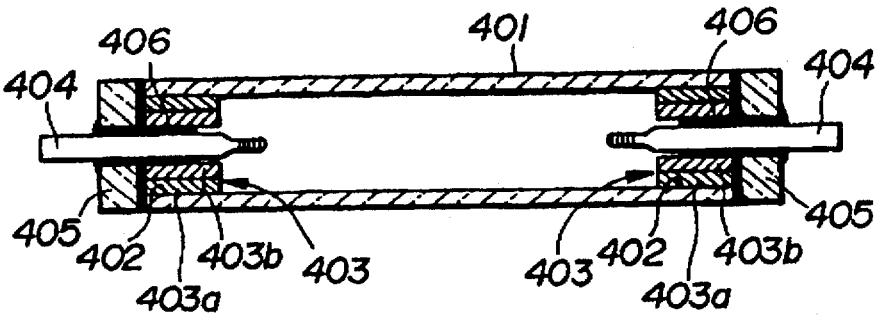
FIG. 20 is a cross-sectional view of a light-emitting bulb assembly according to a fourth embodiment of the present invention.

FIG. 20 shows in cross section a light-emitting bulb assembly according to the fourth embodiment of the present invention, for being incorporated in an outer tube of a metal vapor discharge lamp. A tubular bulb 401 shown in FIG. 20 is made of light-transmissive polycrystalline alumina having a high purity of 99.99%=4N, and electrode sealing members 403 are disposed as closures against inner walls of opposite end openings 402 of the bulb 401.

The electrode sealing members 403 are made of an alumina material having a lower purity of 93~97%, for example, than the bulb 401 which serves as a light-emitting body. Each of the electrode sealing members 403 is of a multilayer structure which comprises a first layer 403*a* as a bulb-side region and a second layer 403*b* as a core-side region (the multilayer structure may be composed of three layers or more including an intermediate layer or layers). The first layer 403*a* held against the inner wall surface of the bulb 401 is made of alumina having a purity of 96%, for example, and the second layer 403*b* inward of the first layer 403*a* is made of alumina having a purity of 93%, for example.

Electrode rods 404 as cores are inserted in the respective electrode sealing members 403, and caps 405 through which the electrode rods 404 extend are disposed against the open ends of the bulb 401. Sealing glass 406 produced by melting and cooling a glass solder is positioned to provide a seal between the electrode sealing members 403 and the electrode rods 404, between the electrode rods 404 and the caps 405, and between the ends of the bulb 401 and the electrode sealing members 403 and the caps 405.

The purity of the caps 405 is preferably an average of the purities of the bulb 401 and the electrode sealing members 403. The caps 408 may be dispensed with as required.

Since a glass component is present in grain boundaries of alumina ceramics in the inner walls of the electrode sealing members 403 which are made of an alumina material having a lower purity than the bulb 401 and which are disposed in the openings of the bulb 401, the electrode sealing members 403 adhere well to the sealing glass solder, thereby improving a sealing capability. A composition gradient structure made of aluminas having different purities serves to suppress the generation of thermal stresses.

A process of manufacturing the above ceramic light-emitting bulb assembly will be described below with reference to FIGS. 21 through 23(*a*)~23(*f*).

Figure 21:
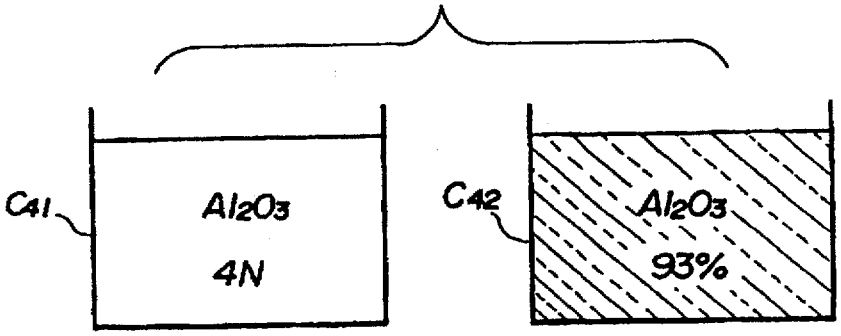
FIG. 21 is a diagram showing materials used to manufacture the light-emitting bulb assembly.
Figure 22:
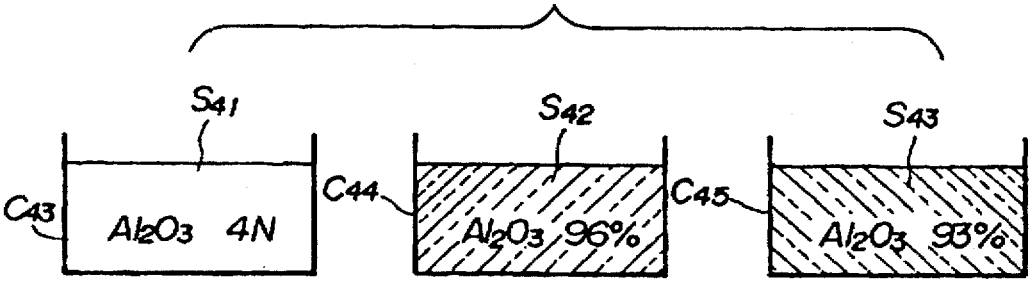
FIG. 22 is a diagram showing respective slips used to manufacture the light-emitting bulb assembly.

First, as shown in FIG. 21, a fine powder of alumina having a high purity of 4N or more for producing light-transmissive alumina is prepared in a container $C_{41}$, and a fine powder of alumina having a lower purity (93% in this embodiment) is prepared in a container $C_{42}$ . The fine powder of low purity contains impurities of silica, magnesia, and so on. The fine powders of alumina should preferably be selected which have similar firing behaviors.

To the powders which have been weighed, there are added predetermined amounts of distilled water, a commercially available dispersing agent, and a binder. The materials are then mixed for 24 hours by a ball mill, producing slips for being east. Suitable amounts of these slips are mixed into several kinds of slips having different purities. The slips are mixed for about 1 hour by a stirrer. In this manner, as shown in FIG. 22, an alumina slip $S_{41}$ having a high purity (4N) is prepared in a container $C_{43}$, an alumina slip $S_{42}$ having a purity of 96% is prepared in a container $C_{44}$, and an alumina slip $S_{43}$ having a purity of 93% is prepared in a container $C_{45}$.

Figures 23, 23B:
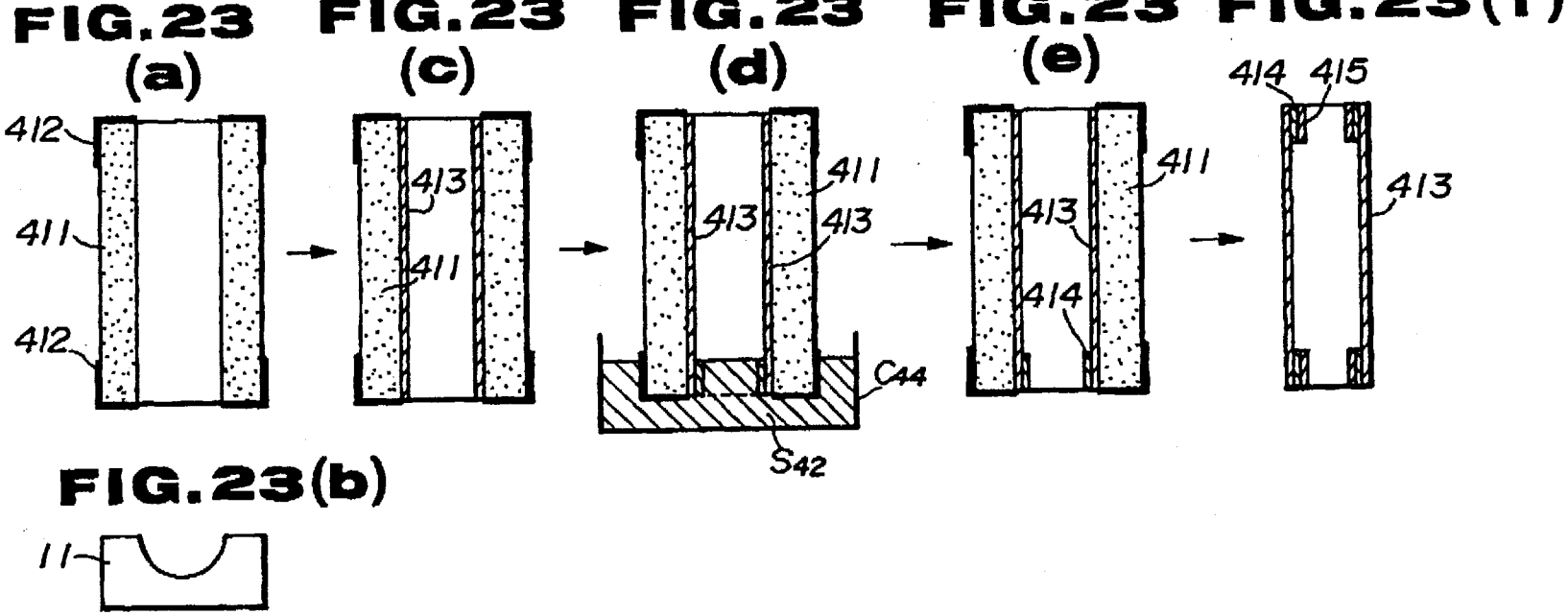
FIGS. 23(*a*) through 23(*f*) are views showing a process of manufacturing the light-emitting bulb assembly.
Figure 24:
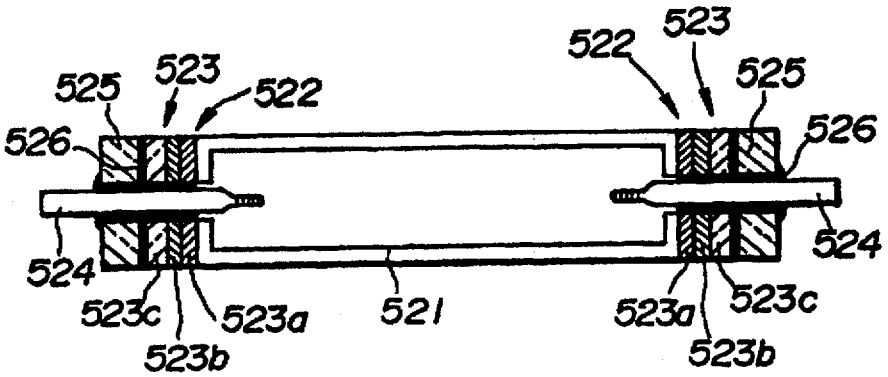
FIG. 24 is a cross-sectional view of a light-emitting bulb assembly according to a fifth embodiment of the present invention.

Thereafter, as shown in FIGS. 23(*a*) and 23(*b*), while masking, with masks 412, peripheral portions of slip inlet/outlet ports of a porous mold assembly or plaster mold assembly 411 that can be divided into two molds (only one mold is shown in the cross-sectional and plan views of FIGS. 23(*a*) and 23(*b*) ), the alumina slip $S_{41}$ having a high purity is poured from the container $C_{43}$ into the plaster mold assembly 411, and left for a predetermined period of time.

After a highly pure alumina layer 413 has been deposited on an inner circumferential surface of the plaster mold assembly 411, the alumina slip $S_{41}$ is discharged.

Then, as shown in FIG. 23(*d*), one end of the plaster mold assembly 411 is dipped in the alumina slip $S_{42}$ having a purity of 96% to deposit an alumina layer on only a sealing portion for thereby forming a 96%-alumina layer 414 on an inner circumferential surface of the highly pure alumina layer 413 as shown in FIG. 23(*e*). Likewise, a 96%-alumina layer 414 is also deposited on an inner circumferential surface of the highly pure alumina layer 413 at the other end of the plaster mold assembly 411, Then, one end of the plaster mold assembly 411 is dipped in the alumina slip $S_{43}$ having a purity of 93% to deposit an alumina layer on only a sealing portion for thereby forming a 93%-alumina layer 415 on an inner circumferential surface of the 96%-alumina layer 414 as Shown in FIG. 23(*f*). Likewise, a 93%-alumina layer 415 is also deposited on an inner circumferential surface of the 96%-alumina layer 414 at the other end of the plaster mold assembly 411.

The formed body thus produced is fired at 1800° C. for 6 hours in a hydrogen reducing atmosphere, thus producing a bulb 401 having a light-emitting portion composed of the light-transmissive alumina layer and sealing portions composed of the electrode sealing members 403 which comprise alumina layers of low purity.

By selecting powders, the bulb may be fired at 1350° C. for 6 hours in the air and thereafter heated at 1350° C. for 2 hours under 1000 atmospheric pressures in an argon atmosphere by way of hot isostatic pressing. In this case, however, since almost no alumina of low purity is generally sintered at this temperature, the purity of alumina in the innermost layer in the sealed portions have to be 97% or higher.

The bulb 401 and the electrode sealing members 403 thus produced are then machined at their inner surfaces and the light-emitting portion is machined at its outer circumferential surface, and then a metal vapor discharge lamp is assembled.

A fifth embodiment which is a modification of the fourth embodiment will be described below with reference to FIGS. 24 through 27(*a*) and 27(*b*) . In the fifth embodiment, a tubular bulb 521 is made of light-transmissive polycrystalline alumina having a high purity of 99.99%=4N, and electrode sealing members 523 of a laminated structure made of alumina of low purity are disposed on respective opposite ends 522 of the bulb 521. Electrode rods 524 as cores are inserted respectively in the electrode sealing members 523. Caps 525 of alumina through which the electrode rods 524 extend are disposed outside of the electrode sealing members 523, and the electrode sealing members 523, the electrode rods 524, and the caps 525 are sealed by sealing glass 526.

The electrode sealing members 523 is made of an alumina material which has a lower purity (e.g., 99~97%) than the bulb 521 which serves as a light-emitting portion. Each of the electrode sealing members 523 is of a laminated structure including a first layer 523*a*, a second layer 523*b*, and a third layer 523*c* (the laminated structure may include four or more layers) arranged along the axial direction of the bulb 521 or the electrode rods 524. The first layer 523*a*, the second layer 523*b*, and the third layer 523*c* are progressively thicker in the direction from the first layer 523*a* toward the third layer 523*c*. As a result, the third layer 523*c* and the second layer 523*b* have a greater area held against the electrode rods 524 than the first layer 523*a*. The caps 525 are made of alumina having the same purity as that of the third layer 523*c*.

The caps 525 may be dispensed with as required.

Figure 25:
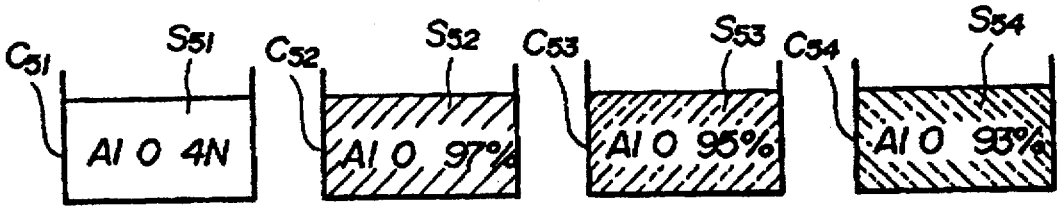
FIG. 25 is a diagram showing respective slips used to manufacture the light-emitting bulb assembly.

A process of manufacturing the above ceramic light-emitting bulb assembly will be described below with reference to FIGS. 25 through 27(*a*) and 27(*b*).

First, as with the fourth embodiment, a fine powder of alumina having a high purity of 4N or more for producing light-transmissive alumina, and a fine powder of alumina having a lower purity (93% in this embodiment) are prepared. To the powders which have been weighed, there are added predetermined amounts of distilled water, a commercially available dispersing agent, and a binder. The materials are then mixed for 24 hours by a ball mill, thereby producing, as shown in FIG. 25, an alumina slip $S_{51}$ having a high purity (4N) is prepared in a container $C_{51}$, an alumina slip S52 having a purity of 97% in a container $C_{52}$, an alumina slip $S_{53}$ having a purity of 95% in a container $C_{53}$, and an alumina slip $S_{54}$ having a purity of 93% in a container $C_{54}$.

Figure 27A:
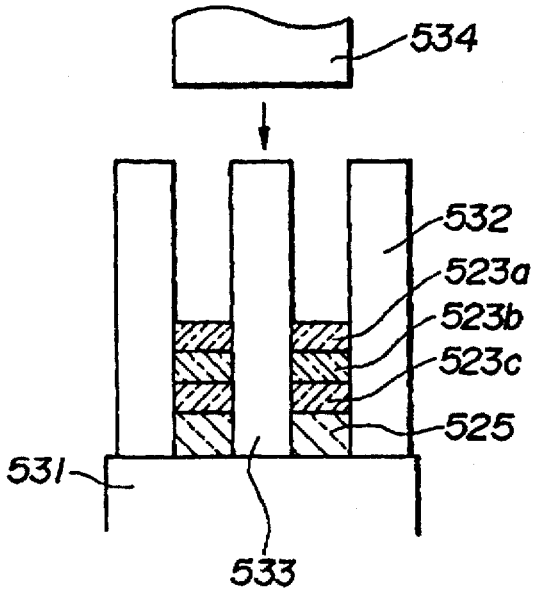
FIGS. 27(*a*) and 27(*b*) are views showing a process of manufacturing the light-emitting bulb assembly.
Figure 27B:
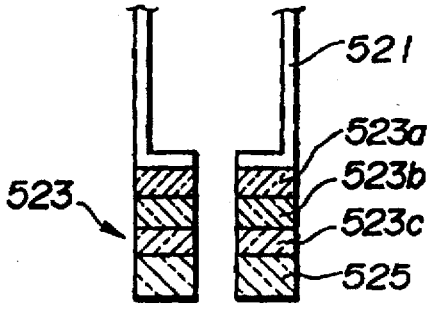

Thereafter, as shown in FIG. 27(*a*), a tubular mold 532 having a size matching the outside diameter of a bulb is Set on a porous mold assembly or plaster mold. assembly 531, and a mold bar 533 is vertically placed centrally in the mold 532. Then, the alumina slip $S_{54}$ having a purity of 93%, the alumina slip $S_{53}$ having a purity of 95%, the alumina slip $S_{52}$ having a purity of 97%, and the alumina slip $S_{51}$ having a high purity are successively poured into a space defined by the mold 532 and the mold bar 533, thereby molding a laminated body. When each of the alumina slips is to be poured, it is poured after the previously poured slip has lost its water content to a certain extent so that they will not be mixed with each other.

Figure 26:
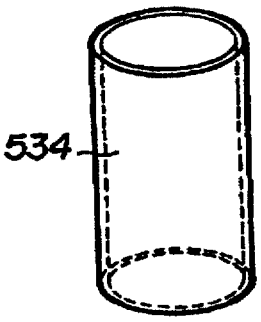
FIG. 26 is a perspective view of a tubular pipe used to manufacture the light-emitting bulb assembly.

A pipe 534 shown in FIG. 26 which will serve as the bulb 521 is formed of the highly pure alumina slip $S_{51}$. The pipe 534 is then inserted into the mold 532 while the highly pure alumina slip $S_{51}$ for producing an end 523*a* of the bulb 521 is not being dried, and integrally joined to the laminated body, thereby producing a molded body as shown in FIG. 27(*b*) . Thereafter, as with the above embodiment, the molded body is fired, machined, and assembled.

With the present invention, as described above, electrode sealing members made of an alumina material having a lower purity than a light-emitting portion are disposed on respective opposite ends of a bulb, and a glass solder or sealing glass is held in contact with the electrode sealing members to keep them out of contact with the bulb. Therefore, the sealing capability is made highly reliable for allowing the lamp to have an increased service life.

As with the above embodiment, since the composition of the electrode sealing members is of a gradient nature, the sealing capability of the sealing regions is further increased.

A sealing structure of a light-emitting bulb assembly for a metal vapor discharge lamp according to a sixth embodiment of the present invention and a method of manufacturing such a sealing structure will be described below with reference to FIGS. 28 through 30(*a*)~30(*d*).

Figure 28:
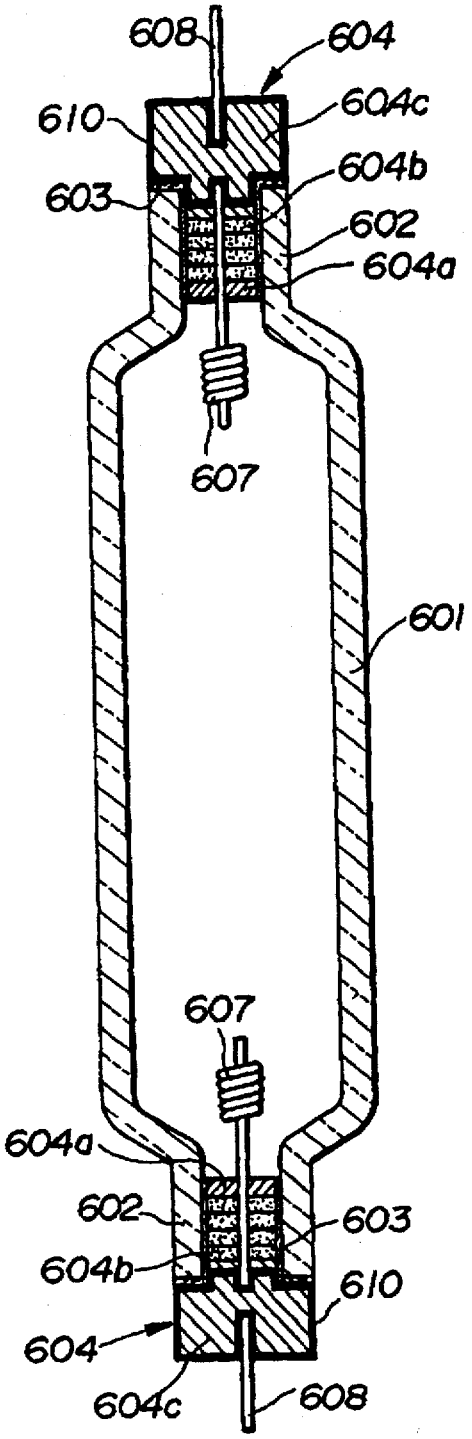
FIG. 28 is a cross-sectional view of a light-emitting bulb assembly according to a sixth embodiment of the present invention.
Figure 29A:
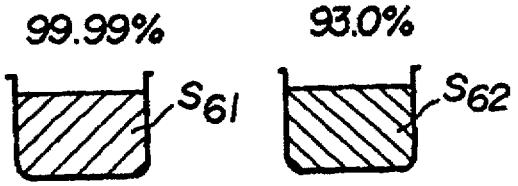
FIGS. 29(*a*) through 29(*e*) are views showing slips used to manufacture a closure of the light-emitting bulb assembly and a process of manufacturing the closure.
Figure 29B:
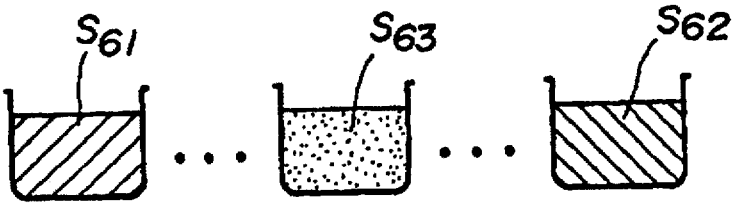
Figure 29C:
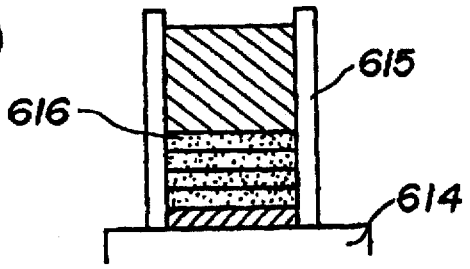
Figure 29D:
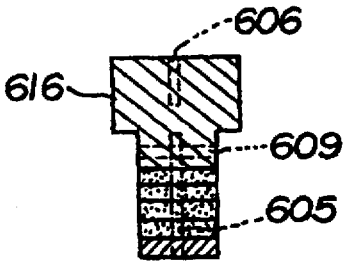
Figure 29E:
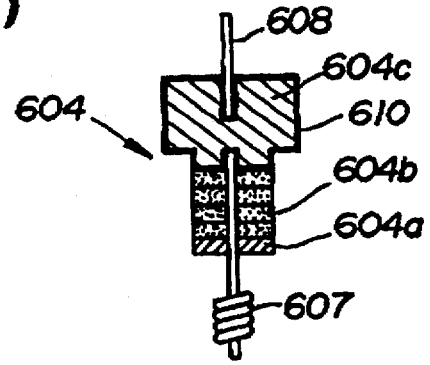

FIG. 28 shows a bulb 601 made of light-transmissive polycrystalline alumina to be incorporated in an outer tube of a metal vapor discharge lamp. Caps 604 of alumina as closures are fitted in respective end openings 602 of the bulb 601 through sealing glass 603.

Each of the caps 604 comprises a high-purity alumina portion 604*a*, a gradient-composition portion 604*b*, and a low-purity alumina portion 604*c*. The high-purity alumina portion 604*a* as a bulb-side region is made of $Al_2O_3$ having a purity of 99.99% and exposed to the interior of the bulb 601. The low-purity alumina portion 604*c* as a core-side region is made of $Al_2O_3$ having a purity of 93.0% and exposed to the exterior of the bulb 601. The gradient-composition portion 604*b* as an intermediate region has a section held against the high-purity alumina portion 604*a* and having a purity of 99.99%, is progressively lower in purity toward the low-purity alumina portion 604*c*, and has a section held against the low-purity alumina portion 604*c* and having a purity of 93.0%. The gradient-composition portion 604*b* with such a continuous gradient composition has a greatly increased peeling strength. The low-purity alumina portion 604*c* has a greater width along the axial direction of the bulb than the width of the high-purity alumina portion 604*a*.

As shown in FIG. 29(*d*), each of the caps 604 has axial holes 605, 606 defined therein. An internal electrode rod 607 is pressed in the hole 605, and an external electrode rod (lead) 608 is pressed in the hole 606. The holes 605, 606 are of such diameters which will be about 200 μm larger than electrode rods 607, 608 after being fired. This prevents the caps from being obstructed and cracked by the electrodes when fired.

The low-purity alumina portion 604*c* has a radial hole 609 defined from its side toward the inside thereof in communication with the axial hole 605. A conductive film 610 of tungsten (W) or the like is disposed in the radial hole 609 and on the outer surface of the low-purity alumina portion 604*c*. The conductive film 610 serves to provide a good electric connection between the internal electrode rod 607 and the external electrode rod 608. The conductive film 610 may be made of Nb, Ta, Mo, Ni, or the like.

A process of manufacturing each of the caps 604 will be described below with reference to FIGS. 29(*a*) through 29(*e*). First, as shown in FIG. 29(*a*), 100 g of $Al_2O_3$ of a high purity (99.99%), 100 g of $Al_2O_3$ of a low purity (93.0%), 50 g of water, and a deflocculant are mixed for 24 hours by a ball mill, thereby producing a slip $S_{61\ of\ Al2}O_3$ of a high purity and a slip $S_{62}$ of $Al_2O_3$ of a low purity.

Then, as shown in FIG. 29(*b*), the slips $S_{61}$, $S_{62}$ are mixed with each other to produce a plurality of slips $S_{63}$ having purities ranging between 99.99% and 93.0%. Thereafter, as shown in FIG. 29(*c*), the slips are successively poured, from the highly pure slip $S_{61}$ to the low purity slip $S_{62}$, into a mold 615 set on a porous body or a plaster body 614, producing a molded body 616 prior to being fired by way of one-sided deposition.

The molded body 616 is then temporarily fired at 1100° C. for 2 hours, so that the molded body 616 has a hardness that allows the molded body 616 to be handled. Thereafter, the molded body 616 is machined to form axial holes 605, 606 and a radial hole 609, as shown in FIG. 19(*d*), and shaped into a cap. A conductive paste 610 is then introduced into the radial hole 609 and applied to the outer surface of the low-purity alumina portion 604*c*. With the internal electrode rod 607 and the external electrode rod 608 being inserted, the assembly is fired at 1570° C. for 3 hours in an atmosphere of $N_2$ and $H_2$ ($N_2$:$H_2$=80:20), thereby producing a cap 604 as shown in FIG. 29(*e*). The cap 604 is inserted in one of the openings 602 of the bulb 601, and sealed by glass 603 or an alloy of a low melting point.

Figure 30:
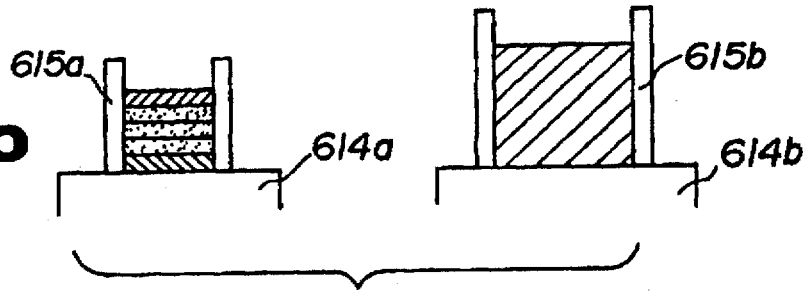
FIGS. 30(*a*) through 30(*d*) are views showing a modification of the process of manufacturing the closure.
Figure 30:
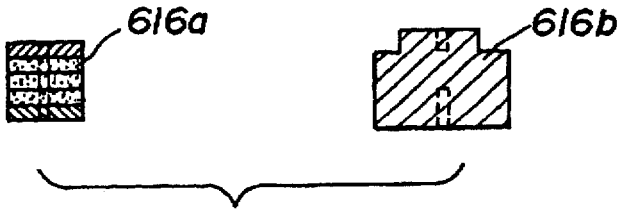
Figure 30C:
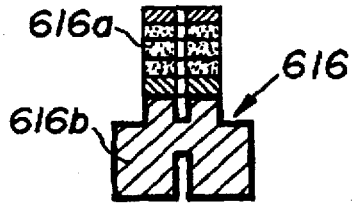
Figure 30D:
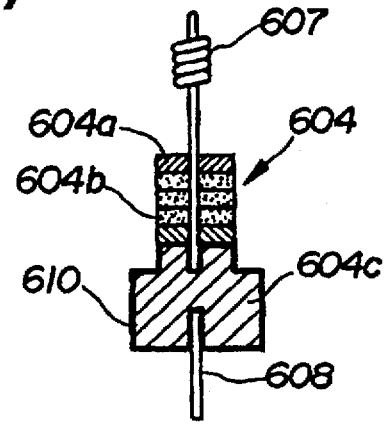

FIGS. 30(*a*) through 30(*d*) show a modification of the process of manufacturing the light-emitting body according to the sixth embodiment. According to the modified process, as shown in FIG. 30(*a*), using two porous bodies or plaster bodies 614*a*, 614*b* and two molds 615*a*, 615*b*, a molded body 616*a* serving as a high-purity alumina portion and a gradient-composition portion, and a molded body 616*b* serving as a low-purity alumina portion are produced as shown in FIG. 30(*b*).

Then, as shown in FIG. 30(*c*), the surface of the molded body 616*b* is coated with a conductive paste, and the molded body 616*a* is bonded integrally to the molded body 616*b1F*by the conductive paste. Subsequently, an internal electrode rod 607 and an external electrode rod 608 are inserted, and the assembly is fired into a cap 604 as shown in FIG. 30(*d*). Since the conductive paste which interconnects the molded bodies 616*a*, 616*b* provides an electric connection between the internal electrode rod 607 and the external electrode rod 608, the radial hole 609 as shown in FIG. 29(*d*) is not required.

According to the sixth embodiment as described above, each of the caps which close respective openings of a light-emitting bulb assembly for a metal vapor discharge lamp and support internal and external electrodes separately from each other is composed of a high-purity alumina portion exposed to the interior of the bulb assembly, a low-purity alumina portion exposed to the exterior of the bulb assembly, a gradient-composition portion interconnecting the high-purity alumina portion and the low-purity alumina portion, and a conductive film which provides an electric connection between the internal and external electrodes and is disposed on the surface of the low-purity alumina portion. The conductive film has a peeling strength increased to 10 kg/cm$^2$ from a conventional value ranging from 1 to 4 kg/cm$^2$.

Since the high-purity alumina portion is exposed to the interior of the bulb assembly, the lamp characteristics are prevented from being degraded due to a corrosive component such as Na. As no conductive film is disposed on the high-purity alumina portion and the gradient-composition portion, no back arcs are produced. Metals such as Nb, Ta, Mo, Ti, and so on may also be used as the conductive film (metallized film).

INDUSTRIAL APPLICABILITY

A sealing structure for a light-emitting bulb assembly allows a discharge light-emitting bulb assembly to be highly reliable and have a long service life. The light-emitting bulb assembly can be used in a metal-vapor discharge lamp such as a mercury-vapor lamp, a metal halide lamp, or a sodium-vapor lamp, or a high-intensity discharge lamp.

Although there have been described what are at present considered to be the preferred embodiments of the invention, it will be understood that the embodiments are presented by way of example only, and that various changes and modifications may be made without departing from the spirit and scope of the invention as defined by the appended claims.

I claim:

1. A sealing structure for a light-emitting bulb assembly, including a closure, having a core which serves an electrode, for sealing an open end of a bulb, said closure including a bulb-side region disposed adjacent to the open end of said bulb and made of a compositional ingredient having a coefficient of thermal expansion which is substantially the same as that of the bulb, a core-side region disposed adjacent to said core and made of a compositional ingredient having a coefficient of thermal expansion which is substantially the same as that of the core, and an intermediate region disposed between said bulb-side region and said core-side region and made of a compositional ingredient having compositional proportions adjusted such that a coefficient of thermal expansion thereof is gradually increased from the coefficient of thermal expansion of said bulb-side region toward the coefficient of thermal expansion of said core-side region; and said bulb-side region and said core-region are separated from each other by said intermediate region and comprise a bulb-side region layer and a core-side layer, respectively, which are independent of each other, and wherein said intermediate region comprises at least one layer whose coefficient of thermal expansion varies gradually from said bulb-side region toward said core-side region and whose electrical conductivity gradually increases from said bulb-side region toward said core-side region.

2. A sealing structure according to claim 1, wherein the layers of said closure are progressively thicker from said bulb-side region layer toward said core-side region layer.

3. A sealing structure according to claim 1, wherein a metal vapor is sealed in said light-emitting bulb assembly.

4. A sealing structure according to claim 1, wherein said closure is made of a gradient function material at least from said bulb-side region through said intermediate region to said core-side region.

5. A sealing structure according to claim 1, wherein said bulb is made of light-transmissive ceramic.

6. A sealing structure according to claim 5, wherein said bulb is made of light-transmissive alumina.

7. A sealing structure according to claim 6, wherein said light-transmissive alumina of the bulb comprises a fired fine powder of alumina having a high purity of at least 99.99 mol %, said light-transmissive alumina having crystal grains having an average particle diameter of at most 1 μm and a maximum particle diameter of at most 2 μm.

8. A sealing structure according to claim 7, wherein the compositional ingredient of said bulb-side region includes alumina having a high purity, the compositional ingredient of said core-side region includes alumina having a low purity, and the compositional ingredient of said intermediate region includes alumina having a graded intermediate purity.

9. A sealing structure according to claim 5, wherein said bulb-side region includes at least 80% by volume of said light-transmissive ceramic, and said core-side region includes at least 50% by volume of a compositional ingredient of said core.

10. A sealing structure according to claim 9, wherein the compositional ingredient of said intermediate region includes light-transmissive ceramic having a volume ratio which is progressively closer to the volume ratio of the light-transmissive ceramic of said bulb-side region in a direction toward said bulb-side region, and also includes the compositional ingredient of said core having a volume ratio which is progressively closer to the volume ratio of the compositional ingredient of said core in said core-side region layer in a direction toward said core-side region layer.

11. A sealing structure according to claim 10, wherein said light-transmissive ceramic includes alumina having a high purity, and said compositional ingredient of said core includes tungsten.

12. A sealing structure according to claim 11, wherein said closure has a support shaft as said core which extends through said closure and supports said electrode so as to position the electrode in the light-emitting bulb assembly, and wherein said closure comprises a laminated body composed of at least three layers concentrically disposed around said support shaft, said three layers including an outermost layer as said bulb-side region, an intermediate region layer as said intermediate region, and an innermost layer as said core-side region.

13. A sealing structure according to claim 12, wherein said open end of the bulb and said outermost layer disposed adjacent thereto are joined in solid phase to each other.

14. A sealing structure according to claim 11, wherein said closure has a support shaft which supports said electrode so as to position the electrode in the light-emitting bulb assembly, and a central layer as said core which has a distal end connected to said support shaft, and wherein said closure comprises a laminated body composed of at least three layers concentrically disposed around said central layer, said three layers including an outermost layer as said bulb-side region, an intermediate region layer as said intermediate region, and an innermost layer as said core-side region.

15. A sealing structure according to claim 14, wherein said open end of the bulb and said outermost layer disposed adjacent thereto are joined in solid phase to each other.

16. A sealing structure according to claim 1, wherein said closure has an electrode rod as said core which extends through said closure and supports said electrode so as to position the electrode in the light-emitting bulb assembly, and wherein said bulb-side region layer is joined to said open end of the bulb, said at least one layer of the intermediate region and said core-side region layer being successively arranged in an axial direction of said bulb.

17. A sealing structure according to claim 16, wherein the layers of said closure are progressively thicker from said bulb-side region layer toward said core-side region layer.

18. A sealing structure according to claim 17, wherein said core-side region layer and said at least one layer of the intermediate region have a greater area disposed adjacent to said electrode rod than said bulb-side region layer, and wherein said bulb-side region layer, said at least one layer of the intermediate region, and said core-side region layer are disposed adjacent said electrode rod through a glass solder interposed therebetween.

19. A sealing structure according to claim 16, wherein a gap is disposed between said bulb-side region layer, said at least one layer of the intermediate region, and said electrode rod.

20. A sealing structure according to claim 1, wherein said closure has an electrode rod as said core which extends through said closure and supports said electrode so as to position the electrode in the light-emitting bulb assembly, and wherein said bulb-side region layer as an outermost layer and said core-side region layer as an innermost layer are concentrically stacked around said electrode rod.

21. A sealing structure according to claim 19, wherein said innermost layer is stacked on said electrode rod through a glass solder interposed therebetween.

22. A sealing structure according to claim 1, wherein said core is positioned substantially centrally in said closure, and said bulb-side region layer, said at least one layer of the intermediate region, and said core-side region layer are stacked in an axial direction of said core, said bulb-side region layer being exposed to an interior of said bulb and disposed adjacent to said bulb.

23. A sealing structure according to claim 22, wherein said core-side region layer has a greater area disposed adjacent to said core than said at least one layer of the intermediate region and said bulb-side region layer.

24. A sealing structure according to claim 23, wherein said core has an internal electrode rod extending from said core-side region layer to said bulb-side region layer and projecting into said bulb and having an electrode on a distal end thereof, and an external electrode rod projecting from said core-side region layer out of said bulb.

25. A sealing structure according to claim 24, wherein a conductive layer is disposed on an outer surface of said core-side region layer and provides an electric connection between said internal electrode rod and said external electrode rod.

26. A sealing structure according to claim 25, wherein said core-side region layer has a through hole defined therein from a side of said core-side region layer to said internal electrode rod, said conductive layer being disposed in said through hole and providing said electric connection between said internal electrode rod and said external electrode rod.

27. A sealing structure according to claim 25, wherein said closure is joined to said open end of said bulb through sealing glass.

28. A sealing structure according to claim 1, wherein said open end of the bulb and said bulb side region layer are joined in solid phase to each other in grain boundaries of joined surfaces.

29. A sealing structure for a light-emitting bulb assembly including a closure, having a core which serves as an electrode, for sealing an open end of a bulb, said closure being made of a gradient function material, the gradient function material comprising at least one layer whose compositional proportions vary therethrough.

30. A sealing structure according to claim 29, wherein the layers of said closure are stacked concentrically around said core.

31. A sealing structure according to claim 29, wherein said gradient function material includes different compositional ingredients, a coefficient of thermal expansion of the gradient function material varies gradually in an order of arrangement of the different compositional ingredients therein, and an electrical conductivity of the gradient function material varies gradually in the order of arrangement of the different compositional ingredients therein.

32. A sealing structure according to claim 29, wherein said closure is produced by a slip casting using slurry.

33. A sealing structure for a light-emitting bulb assembly including a closure, having a core which serves as an electrode, for sealing an open end of a bulb, said closure exclusive of said core having compositional proportions which vary along an axial direction of the bulb.

34. A sealing structure according to claim 33, wherein the compositional proportions of the closure also vary along a radial direction of the bulb.

35. A sealing structure for a light-emitting bulb assembly including a closure, having a core which serves as an electrode, for sealing an open end of a bulb, said closure exclusive of said core having compositional proportions which vary along two different directions of the bulb.

36. A sealing structure according to claim 35, wherein said two different directions are substantially perpendicular to each other.

37. A sealing structure for a light-emitting bulb assembly including a closure, having a core which serves as an electrode, for sealing an open end of a bulb, said closure exclusive of said core having a conductive layer and a non-conductive layer, each said conductive and non-conductive layer having compositional proportions which vary therethrough.

* * * * *

UNITED STATES PATENT AND TRADEMARK OFFICE

CERTIFICATE OF CORRECTION

PATENT NO. : 5,742,123

DATED : 21 April 1998

INVENTOR(S) : Hiroyuki Nagayama

It is certified that error appears in the above-indentified patent and that said Letters Patent is hereby corrected as shown below:

On the cover page, in the Abstract (section [57]), lines 3-4, after "electrode" insert a comma.

Column 3, lines 13-14, after "electrode" insert a comma;
line 39, after "electrode" insert a comma;
line 47, change "core proportion of" to --proportion of core--.

Column 5, line 28, change "termediate" to --intermediate--.

Column 6, line 3, after "layers" insert a comma.

Column 7, line 57, change "dissolved1Ftogether" to --dissolved together--.

Column 8, 18th line, change "24" to --24--.

Column 9, line after number 30, change "bonized" to --carbonized--.

Column 10, line 24, delete "having" (second occurrence only);
line 25, before "wavelength" insert --a--.

Column 13, line 14, change "such1Fcomposition" to --such composition--;
line 29, change "that1Fthe" to --that the--.

Column 15, approximately line 45, in the third line of Table 6, change "3/79" to --3/97--.

Column 14, line 27, change "outer-most" to --outermost--.

Column 18, line 42, before "tenth" insert --the--;
line 48, change "power" to --powder--;
line 62, change "creases" to --decreases--.

Column 19, line 30, change "Until" to --When--.

Column 23, line 7, change "In" to --in--;
line 62, change "$303_{-1}$" to --$303_{n-1}$--;
line 64, change "$303_{-1}$" to --$303_{n-1}$--.

UNITED STATES PATENT AND TRADEMARK OFFICE

CERTIFICATE OF CORRECTION

PATENT NO. : 5,742,123

DATED : 21 April 1998

INVENTOR(S) : Hiroyuki Nagayama

It is certified that error appears in the above-indentified patent and that said Letters Patent is hereby corrected as shown below:

Column 24, line 6, change "$303_{-1}$" to --$303_{n-1}$--;
line 8, change "$303_{-1}$" to --$303_{n-1}$--.

Column 26, line 27, change "408" to --405--;
line 52, change "east" to --cast--.

Column 27, 17th line, change "Shown" to --shown--.

Column 28, line 20, change "Set" to --set--;
line 36, delete "being".

Column 29, line 35, change "$_{of}Al_2O_3$" to --of $Al_2O_3$--.

Column 30, line 4, change "616blFby" to --616b by--;
line 52, after "serves" insert --as--.

Column 31, line 1, change "core-region" to --core-side region--;
line 3, after "core-side" insert --region--.

Column 33, line 11, change "bulb side" to --bulb-side--;
line 16, after "closure" insert --exclusive of said core--.

Signed and Sealed this

Twenty-seventh Day of October, 1998

*Attest:*

Bruce Lehman

BRUCE LEHMAN

*Attesting Officer*

*Commissioner of Patents and Trademarks*